US012043888B2

(12) United States Patent
Holder et al.

(10) Patent No.: US 12,043,888 B2
(45) Date of Patent: Jul. 23, 2024

(54) HARDENED CASE-NITRIDED METAL ARTICLES AND METHODS OF FORMING THE SAME

(71) Applicant: The Boeing Company, Arlington, VA (US)

(72) Inventors: Scott M. Holder, Cherry Hill, NJ (US); Dale J. Weires, Hockessin, DE (US)

(73) Assignee: The Boeing Company, Arlington, VA (US)

( * ) Notice: Subject to any disclaimer, the term of this patent is extended or adjusted under 35 U.S.C. 154(b) by 0 days.

(21) Appl. No.: 18/183,012

(22) Filed: Mar. 13, 2023

(65) Prior Publication Data

US 2023/0227955 A1 Jul. 20, 2023

Related U.S. Application Data

(63) Continuation of application No. 17/528,996, filed on Nov. 17, 2021, now Pat. No. 11,634,806.

(60) Provisional application No. 63/159,145, filed on Mar. 10, 2021.

(51) Int. Cl.

| | |
|---|---|
| ***C22F 1/18*** | (2006.01) |
| ***C23C 8/24*** | (2006.01) |
| ***C23C 8/80*** | (2006.01) |

(52) U.S. Cl.
CPC ..... *C22F 1/183* (2013.01); *C23C 8/24* (2013.01); *C23C 8/80* (2013.01)

(58) Field of Classification Search
CPC ..... C23C 8/24; C23C 8/80; C22F 1/183
See application file for complete search history.

(56) References Cited

U.S. PATENT DOCUMENTS

| | | | |
|---|---|---|---|
| 5,173,134 | A | 12/1992 | Chakrabarti et al. |
| 8,496,872 | B1 | 7/2013 | Weires et al. |
| 9,718,256 | B2 | 8/2017 | Gyotoku et al. |
| 9,790,583 | B2 | 10/2017 | Weires et al. |
| 10,151,019 | B2 | 12/2018 | Araoka et al. |

FOREIGN PATENT DOCUMENTS

| | | | |
|---|---|---|---|
| RU | 2558320 | C1 | 7/2015 |
| RU | 2736246 | C1 | 11/2020 |
| WO | 2013140869 | A1 | 9/2013 |

OTHER PUBLICATIONS

English Abstract and English Machine Translation of Gyotoku et al. (WO 2013/140869) (Sep. 26, 2013).*
Anonymous, "Heat Treating—Wikipedia, the free encyclopedia," retrieved from Wikipedia.org on Jan. 20, 2021.
Fedirko et al., "Thermodiffusion Saturation of the Surface of VT22 Titanium Alloy from a Controlled Oxygen-Nitrogen-Containing Atmosphere in the Stage of Aging," Materials Science, vol. 53, No. 5, pp. 691-701 (Mar. 2018).
Machine-generated English language translation for RU 2558320 C1, dated Jul. 27, 2015.
Machine-generated English language translation for RU 2736246 C1, dated Nov. 12, 2020.

* cited by examiner

*Primary Examiner* — Jessee R Roe
(74) *Attorney, Agent, or Firm* — Kolitch Romano Dascenzo Gates LLC

(57) ABSTRACT

Methods of hardening a case-nitrided metal article, methods of producing a hardened case-nitrided metal article, and hardened case-nitrided metal articles. The methods of hardening a case-nitrided metal article include heating the case-nitrided metal article to an aging temperature, maintaining the case-nitrided metal article at the aging temperature for an aging time, and cooling the case-nitrided metal article from the aging temperature. The methods of producing a hardened case-nitrided metal article include case-nitriding a metal article to produce a case-nitrided metal article and subsequently hardening the case-nitrided metal article. The hardened case-nitrided metal article comprises a body formed of a metal or a metal alloy, a surface surrounding the body, and a nitrided case layer formed in the body and extending inwardly from the surface of the body toward the core that includes a hardness that is greater than that of an otherwise equivalent case-nitrided metal article.

21 Claims, 7 Drawing Sheets

700

| | Rod 702 | | Rod 704 | | Rod 706 | | Rod 708 | | Rod 710 | | |
|---|---|---|---|---|---|---|---|---|---|---|---|
| Depth (inch) | Test 1 | Test 2 | Test 3 | Test 4 | Test 5 | Test 6 | Test 7 | Test 8 | Test 9 | Test 10 | |
| 0.003 | 46.5 | 51.4 | 45.5 | 53.5 | 47.4 | 54.7 | 46.7 | 56.7 | 47.2 | 57.4 | Hardness (HRC) |
| 0.005 | 47.4 | 50.2 | 45 | 52.8 | 44.3 | 52.8 | 46.9 | 55.2 | 45 | 55.5 | |
| 0.007 | 43.4 | 50.2 | 44.8 | 51.4 | 43.2 | 52.3 | 47.2 | 54.3 | 45.8 | 53.5 | |
| 0.010 | 35.3 | 50.2 | 47.6 | 52.1 | 46.7 | 51.6 | 43.6 | 51.6 | 45.3 | 52.8 | |
| 0.015 | 32.4 | 49.1 | 38.5 | 50.9 | 40.3 | 51.2 | 46 | 51.4 | 46.7 | 51.4 | |
| 0.020 | 31 | 48.8 | 34 | 49.3 | 35.5 | 50.2 | 42.4 | 51.4 | 43.2 | 51.6 | |
| 0.025 | 30.4 | 47.4 | 31.6 | 48.4 | 32.6 | 49.3 | 37.1 | 50.2 | 37.1 | 50.4 | |
| 0.030 | 29.6 | 46.9 | 30.4 | 47.4 | 31.2 | 48.4 | 33.8 | 49.3 | 33.8 | 49.5 | |
| 0.035 | 29.8 | 46.7 | 30 | 47.4 | 30 | 47.4 | 32.6 | 48.8 | 32.2 | 48.8 | |
| 0.040 | 29.6 | 47.2 | 29.8 | 46.9 | 29.8 | 47.4 | 31.2 | 47.9 | 30.6 | 47.9 | |
| 0.045 | 29.8 | 47.4 | 29.8 | 47.2 | 29.8 | 46.9 | 31 | 47.6 | 30.2 | 47.4 | |
| 0.050 | 29.4 | 46.9 | 29.6 | 47.4 | 29.6 | 46.9 | 30.4 | 47.4 | 29.8 | 47.2 | |
| 0.055 | 29.2 | 46.9 | 29 | 46.9 | 29.6 | 47.2 | 30.2 | 46.9 | 29.4 | 47.2 | |
| ECD to HRC 50 (inch) | N/A | 0.011 | N/A | 0.0178 | N/A | 0.0211 | N/A | 0.0261 | N/A | 0.0274 | |
| Surface Hardness (15N) | 85 | 88 | 85 | 90 | 87 | 91 | 90 | 91 | 91 | 92 | |
| Core Hardness (HRC) | 29 | 47 | 29 | 47 | 30 | 47 | 30 | 47 | 30 | 47 | |
| Porous Layer (inch) | 0.0010 | 0.0010 | 0.0017 | 0.0017 | 0.0025 | 0.0025 | 0.0047 | 0.0047 | 0.0064 | 0.0064 | |

FIG. 5

HARDENED CASE-NITRIDED METAL ARTICLES AND METHODS OF FORMING THE SAME

RELATED APPLICATION

The present application claims priority to U.S. patent application Ser. No. 17/528,996, filed on Nov. 17, 2021, now U.S. Pat. No. 11,634,806, and Provisional Patent Application No. 63/1459,145, filed on Mar. 10, 2021, both entitled "HARDENED CASE-NITRIDED METAL ARTICLES AND METHODS OF FORMING THE SAME," the complete disclosures of which are incorporated by reference.

GOVERNMENT RIGHTS

This invention was made with Government support under W911W6-16-2-0010 awarded by the Department of Defense. The government has certain rights in this invention.

FIELD

The present disclosure relates to hardened case-nitrided metal articles and methods of forming the same.

BACKGROUND

Many metals and metal alloys require a hardening treatment to possess adequate hardness for use in a variety of mechanical applications such as wear parts. Nitriding is an example of a common hardening technique that is utilized in various industries to case-harden metal or metal alloy components. Generally speaking, the nitriding process diffuses nitrogen through the surface of a metal or metal alloy component to produce a thin nitrided case layer that surrounds and is hardened relative to a core of the component. While some metals and metal alloys are rendered to be adequately wear resistant by nitriding to be utilized as mechanical components, other metals and metal alloys are less responsive to nitriding and remain overly prone to wear mechanisms associated with inadequate hardness or case depth for use in many mechanical applications.

Examples of such metals and metal alloys include titanium and titanium alloys. While the nitriding of titanium has been described in literature for over 50 years, current processes for nitriding titanium and titanium alloys produce very thin case depths. Particularly for wear parts such as gears or bearings, the nitrided case depth should be deeper than the stresses experienced by the component during operation to avoid failure. Typically, titanium and titanium alloys that are nitrided by existing techniques do not possess a sufficient case depth to support the subsurface stresses experienced by many wear parts, and thus are not suitable for these applications. Owing to the otherwise excellent material properties of titanium and titanium alloys, including a high strength to weight ratio, many industries have long sought to form various mechanical components from these materials but have been unable to effectively do so because of the inability of existing techniques to achieve adequate effective case depths. Thus, a need exists for improved methods of increasing the hardness of case-nitrided metal or metal alloy articles, methods for increasing the effective case depth of metal or metal alloy articles, as well as case-nitrided metal or metal alloy articles with increased hardness and/or increased effective case depth.

SUMMARY

Methods of hardening a case-nitrided metal article, methods of producing a hardened case-nitrided metal article, and hardened case-nitrided metal articles are disclosed herein. The methods of hardening a case-nitrided metal article include heat-aging the case-nitrided metal article, which comprises heating the case-nitrided metal article to an aging temperature, maintaining the case-nitrided metal article at the aging temperature for an aging time, and cooling the case-nitrided metal article from the aging temperature. The methods of producing a hardened case-nitrided metal article include case-nitriding a metal article to produce a case-nitrided metal article and subsequently hardening the case-nitrided metal article, which includes heating the case-nitrided metal article to an aging temperature, maintaining the case-nitrided metal article at the aging temperature for an aging time, and cooling the case-nitrided metal article from the aging temperature. The hardened case-nitrided metal articles comprise a body formed of a metal or a metal alloy, a surface surrounding the body, and a nitrided case layer formed in the body and extending inwardly from the surface of the body toward the core. The hardened case-nitrided metal articles are nitrided by a nitriding process and subsequently hardened by a hardening process. The nitrided case layer of the hardened case-nitrided metal articles comprises a hardness that is greater than an otherwise equivalent case-nitrided metal article that has not been hardened by the heat aging process.

BRIEF DESCRIPTION OF THE DRAWINGS

FIG. 5 illustrates a table including test results from case-nitriding and subsequent hardening of Ti-5553 rods.

DESCRIPTION

Figure 1:
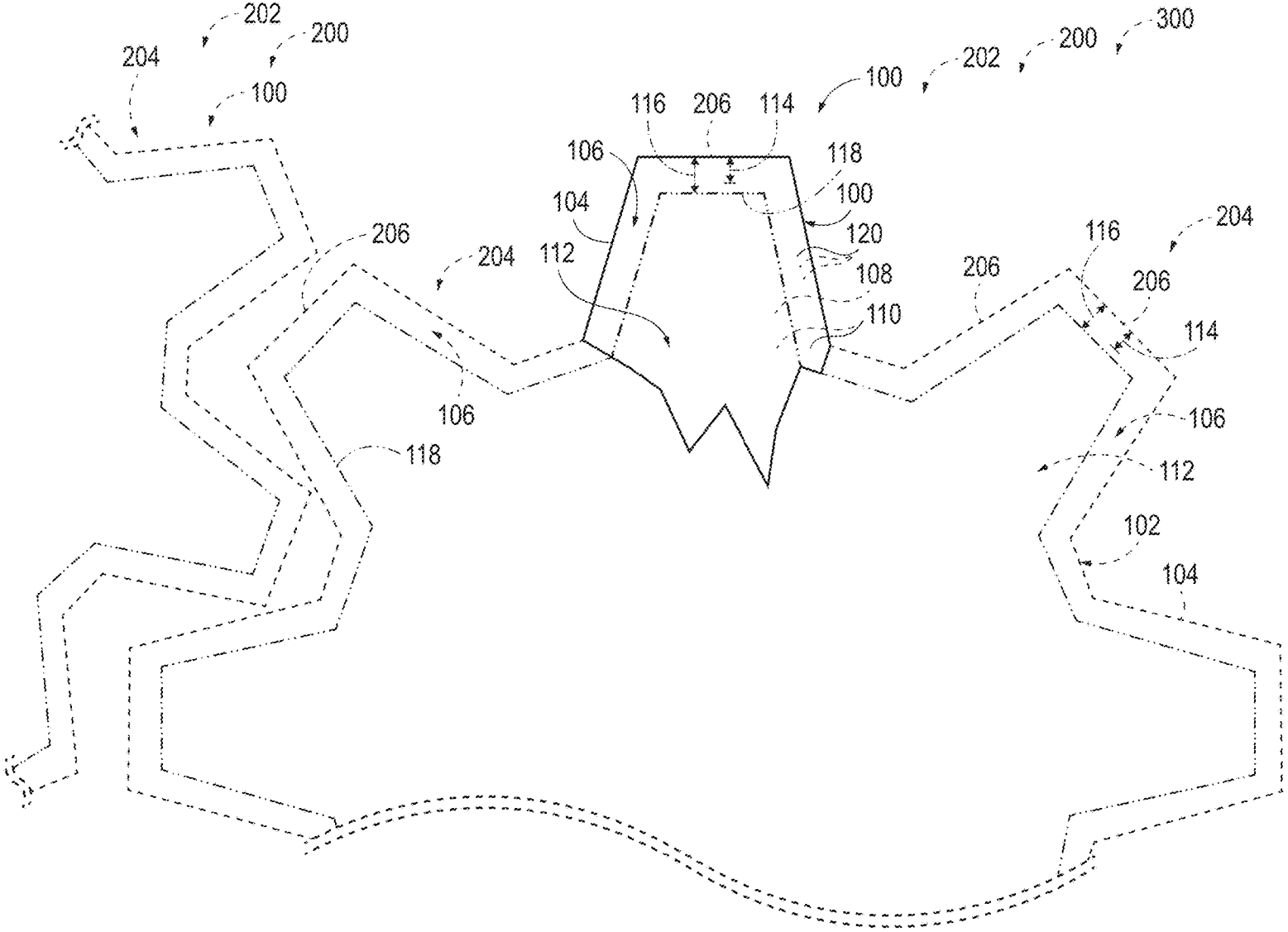
FIG. 1 is a schematic representation of examples of hardened case-nitrided metal articles according to the present disclosure.

FIGS. 1-9 illustrate examples of hardened case-nitrided metal articles 100, hardened case-nitrided wear parts 200, mechanical systems 300 that include hardened case-nitrided wear parts 200, methods 500 of hardening case-nitrided metal articles, and methods 600 of producing case-nitrided metal articles according to the present disclosure. Elements that serve a similar, or at least substantially similar, purpose are labeled with like numbers in each of FIGS. 1-9 and these elements may not be discussed in detail herein with reference to each of FIGS. 1-9. Similarly, all elements may not be labeled in each of FIGS. 1-9, but reference numerals associated therewith may be utilized herein for consistency. Elements, components, and/or features that are discussed herein with reference to one or more of FIGS. 1-9 may be included in and/or utilized with any of FIGS. 1-9 without departing from the scope of the present disclosure.

Figure 4:
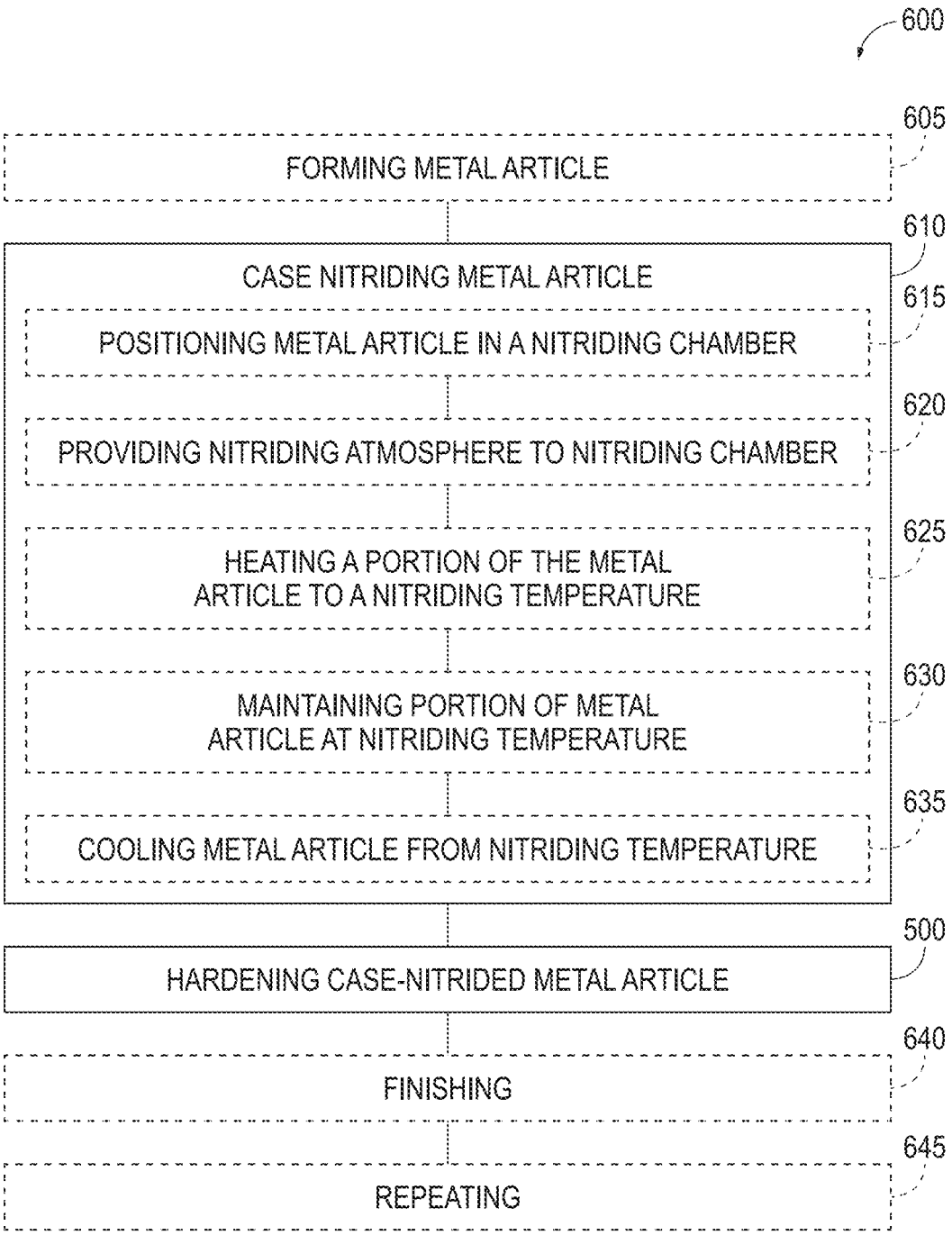
FIG. 4 is a flowchart schematically representing examples of methods of producing a hardened case-nitrided metal article according to the present disclosure.

Generally, in the figures, elements that are likely to be included in a given example are illustrated in solid lines, while elements that are optional to a given example are illustrated in dashed lines. However, elements that are illustrated in solid lines are not essential to all examples of the present disclosure, and an element shown in solid lines may be omitted from a particular example without departing from the scope of the present disclosure. In FIGS. 1 and 4, dot-dash lines are utilized to indicate various dimensions and/or depths, and dot-dot-dash lines are utilized to indicate boundaries, transitions, and/or spatial variation in physical properties and/or composition of an illustrated embodiment.

FIG. 1 is a schematic cross-sectional representation showing examples of hardened case-nitrided metal articles 100 according to the present disclosure. As shown in the examples of FIG. 1, hardened case-nitrided metal article 100 includes a body 102 formed of a metal 108 or a metal alloy 110, a surface 104 surrounding the body 102, and a nitrided case layer 106 formed in the body 102 and extending inwardly from the surface towards a core 112 of the body 102. Hardened case-nitrided metal article 100 is a metal article that has been case-nitrided by a nitriding process and subsequently hardened by a heat-aging process. As discussed in more detail herein, the nitriding process produces the nitrided case layer 106 within the metal article, and the hardening process increases the hardness of the nitrided case layer 106. Thus, a metal article that has been case-nitrided via a nitriding process may be referred to herein as a case-nitrided metal article, and a metal article that has been case-nitrided via a nitriding process and subsequently hardened is referred to herein as the hardened case-nitrided metal article 100. Additionally or alternatively, the nitrided case layer 106 of hardened case-nitrided metal article 100 may be referred to as a hardened nitrided case layer. As further discussed herein, the hardening process comprises heat-aging the case-nitrided metal article.

As shown in FIG. 1, the nitrided case layer 106 includes one or more nitrogen-containing phases 120, with examples of nitrogen-containing phases 120 including one or more metal nitrides, one or more dissolved nitrogen-containing phases, and/or one or more interstitial nitrogen-containing phases. Stated differently, nitrogen is diffused into the metal article and immobilized therein in one or more phases, forms, chemical bonding environments, and/or complexes during the nitriding process. Thus, the nitrided case layer 106 of a case-nitrided metal article additionally or alternatively may be referred to herein as the nitrogen-diffused case layer.

The particular type(s), total amount, relative amount(s), and/or distribution(s) of the nitrogen-containing phase(s) 120 within the nitrided case layer 106 may vary based on the type of metal 108 or metal alloy 110 and the parameters of the nitriding process. In some examples, the heat-aging process alters the type(s), the phase(s), the form(s), the relative amount(s), and/or the distribution(s) of the nitrogen-containing phase(s) 120 within the nitrided case layer 106. Thus, in such examples, the particular type(s), relative amount(s), and/or distribution(s) of the nitrogen-containing phase(s) 120 within the nitrided case layer 106 additionally or alternatively are determined by the heat-aging process. Stated differently, the type(s), the phase(s), the form(s), the relative amount(s), and/or the distribution(s) of the nitrogen-containing phase(s) 120 within the nitrided case layer 106 of hardened case-nitrided metal article 100 may be different from that present in an otherwise equivalent case-nitrided metal article.

As referred to herein, a case-nitrided metal article that is "otherwise equivalent" to a hardened case-nitrided metal article 100 is formed of the same metal or metal alloy, includes the same dimensions, and has been case-nitrided via the same case-nitriding process as the hardened case-nitrided metal article 100 but has not been hardened via the heat-aging process subsequent to the case-nitriding process. Thus, in a more specific example where a single metal article is nitrided and subsequently heat aged, the "otherwise equivalent" case-nitrided metal article describes the material properties subsequent to the nitriding process and prior to the heat-aging process.

As further shown in FIG. 1, the nitrided case layer 106 defines a total case depth 116, which is measured between surface 104 and a nitrogen diffusion boundary 118. The nitrogen diffusion boundary 118 delineates the maximal extent to which nitrogen is diffused into body 102 by the nitriding process and, in some examples, by the heat-aging process. Thus, the core 112 may be described as the portion of the hardened case-nitrided metal article 100 that is beneath the nitrogen diffusion boundary 118 and that may not include detectable quantities of nitrogen-containing phase(s) 120, or at least those resulting from the nitriding process.

Hardened case-nitrided metal article 100 is formed from any suitable metal 108 or metal alloy 110. As utilized herein, a metal 108 refers to a pure or elemental metal that may include incidental impurities, and a metal alloy 110 includes a mixture of at least one metal and at least one other metal and/or one or more non-metallic elements. As used to herein, the hardened case-nitrided metal article 100 being formed of a metal 108 or metal alloy 110 means that the metal article from which the hardened case-nitrided metal article 100 is formed, consists of, or consists essentially of, the metal 108 or metal alloy 110. As such, even when core 112 of hardened case-nitrided metal article 100 is formed of a metal 108, nitrided case layer 106 may be regarded as being a metal alloy 110 owing to the diffused nitrogen content.

In some examples, the metal 108 or metal alloy 110 that forms hardened case-nitrided metal article 100 is selected to further harden via a heat-aging process subsequent to being nitrided. As discussed in more detail herein, in some examples, the heat-aging process comprises precipitation-hardening the nitrided case layer 106. As such, in some examples, hardened case-nitrided metal article 100 is formed of a precipitation-hardening metal or a precipitation-hardening metal alloy. In some examples, the metal 108 or metal alloy 110 that forms hardened case-nitrided metal article 100 is selected to be compatible with solution treatment and heat-aging. In some examples, the metal 108 or metal alloy 110 that forms hardened case-nitrided metal article 100 is selected to be compatible with nitriding. As more specific examples, hardened case-nitrided metal article 100 may be formed of an iron alloy, a steel, stainless steel, and/or a titanium alloy. More specific examples of suitable titanium alloys include a Ti—Al—V—Mo—Cr alloy, Ti-5Al-5V-5Mo-3Cr (Ti-5553), a Ti—Al—V alloy, and/or Ti-6Al-4V (Ti-64).

When hardened case-nitrided metal article 100 is formed of a titanium alloy, hardened case-nitrided metal article 100 may be referred to herein as hardened case-nitrided titanium alloy article 100. Likewise, when hardened case-nitrided metal article 100 is formed of Ti-5553, hardened case-nitrided metal article 100 may be referred to herein as hardened case-nitrided Ti-5553 article 100.

In addition to the hardening process, the nominal hardness of nitrided case layer 106 of hardened case-nitrided metal article 100 may depend upon the type of metal 108 or metal alloy 110 that forms hardened case-nitrided metal article 100, the depth from the surface 104, and the parameters or type of nitriding process that is utilized for the case-nitriding. Generally speaking, case-nitriding is performed to harden the surface or outermost layer of a metal article. Thus, the nitrided case layer 106 of a case-nitrided metal article and of hardened case-nitrided metal article 100 typically possesses a hardness that is greater than the hardness of the core 112. Typically, the hardness of the nitrided case layer 106 decreases at greater depths towards the core 112.

As mentioned, the hardening process increases the hardness of the nitrided case layer 106. Thus, the nitrided case layer 106 of hardened case-nitrided metal article 100 has a hardness that is greater than the hardness of the nitrided case layer 106 of an otherwise equivalent case-nitrided metal article. In particular, at least a portion of, and in some examples, the entirety of, the nitrided case layer 106 of hardened case-nitrided metal article 100 is harder than the nitrided case layer 106 of an otherwise equivalent case-nitrided metal article. More specifically, the hardness of the hardened case-nitrided metal article at a given depth may be greater than a hardness of the nitrided case layer of the otherwise equivalent case-nitrided metal article at the given depth.

As a more specific example, the hardened case-nitrided metal article 100 has a second hardness measured at a given depth within the nitrided case layer 106, the otherwise equivalent case-nitrided metal article has a first hardness measured at the given depth within its respective nitrided case layer, and the second hardness of the hardened case-nitrided metal article 100 is greater than the first hardness of the otherwise equivalent case-nitrided metal article. In some examples, the second hardness of the hardened case-nitrided metal article is a threshold fraction of the first hardness of the otherwise equivalent case-nitrided metal article, with examples of the threshold fraction of the first hardness to the second hardness including at least 1.1, at least 1.2, at least 1.3, at least 1.4, at least 1.5, at least 1.6, at least 1.7, at least 2, at most 1.2, at most 1.3, at most 1.4, at most 1.5, at most 1.6, at most 1.7, at most 1.8, at most 1.9, at most 2, and/or at most 3.

In some examples, an age hardening process also hardens the core 112 of body 102. In some examples, hardened case-nitrided metal article 100 includes a core hardness that is greater than a core hardness of an otherwise equivalent case-nitrided metal article. As referred to herein, a core hardness refers to the hardness of core 112, the hardness of interior region of body 102 that is not nitrided, or the hardness of body 102 at a depth that is beyond the nitrogen diffusion boundary 118. In some examples the core hardness is measured at the geometric center of a metallurgical cross-section of body 102. In some examples, the core hardness of hardened case-nitrided metal article 100 is a threshold fraction of the core hardness of an otherwise equivalent case-nitrided metal article, with examples of the threshold fraction including at least 1.2, at least 1.3, at least 1.4, at least 1.5, at least 1.6, at least 1.7, at least 1.8, at most 1.5, at most 1.6, at most 1.7, at most 1.8, at most 1.9, and at most 2.0.

In the present disclosure, hardness may be measured and/or reported in any suitable manner. As examples, the harnesses discussed herein may include Rockwell hardness, Rockwell C hardness (HRC), Rockwell 15N hardness (HRN 15), Vickers hardness (VH), and/or Brinell hardness (BH). Effective case depth 114 is another metric that may be utilized herein for discussing the hardness of nitrided case layer 106, hardened case-nitrided metal article 100, and a case-nitrided metal article. Effective case depth 114 is defined herein as the depth from surface 104 that the hardness of body 102 is greater than or equal to HRC 50. As shown in FIG. 1, in some examples, the effective case depth 114 is defined within the total case depth of the nitrided case layer 106.

In some examples, hardened case-nitrided metal article 100 includes an effective case depth 114 that is greater than the effective case depth 114 of an otherwise equivalent case-nitrided metal article. As examples, the effective case depth 114 of hardened case-nitrided metal article 100 may be at least 0.25 millimeters (mm), at least 0.45 mm, at least 0.5 mm, at least 0.55 mm, at least 0.6 mm, at least 0.65 mm, at least 0.7 mm, at most 0.8 mm, at most 0.9 mm, and at most 1 mm. As more examples, the effective case depth 114 of hardened case-nitrided metal article 100 may be greater than the effective case depth 114 of an otherwise equivalent case-nitrided metal article by at least 0.25 mm, at least 0.45 mm, at least 0.5 mm, at least 0.55 mm, at least 0.6 mm, at least 0.65 mm, at least 0.7 mm, at most 0.8 mm, at most 0.9 mm, at most 1 mm, and/or at most 1.5 mm. In some examples, the otherwise equivalent case-nitrided metal article does not achieve an effective case depth 114 as defined herein, in which case the entirety of the effective case depth 114 of the hardened case-nitrided metal article 100 is taken to be an increase over the otherwise equivalent case-nitrided metal article. As a more specific example, when hardened case-nitrided metal article 100 is formed of Ti-5553, hardened case-nitrided metal article 100 may include an effective case depth 114 of at least 0.25 mm, at least 0.45 mm, at least 0.5 mm, at least 0.55 mm, at least 0.6 mm, at least 0.65 mm, at least 0.7 mm, at most 0.8 mm, at most 0.9 mm, and at most 1 mm.

With continued reference to FIG. 1, in some examples, hardened case-nitrided metal article 100 is or is included in a wear part 200. When hardened case-nitrided metal article 100 is or is included in a wear part, the wear part 200 may be referred to herein as a hardened case-nitrided wear part 200. As defined herein, a wear part is a part, component, or structure within a mechanical system that dynamically engages at least one other component, part, or structure and that historically is designed to wear within the mechanical system. Examples of mechanisms by which a traditional wear part may wear during use include galling, spalling, scoring, and fretting. More specific examples of wear parts 200 include bearings, cogs, chucks, shanks, gears, rollers, crank shafts, camshafts, cam followers, valves, extruder screws, dies, bushings, pins, and the like.

As shown in FIG. 1, wear part 200 includes body 102 formed of a metal 108 or a metal alloy 110, a surface 104 surrounding the body 102. Surface 104 of wear part 200 includes at least one wear surface 206, and optionally a plurality of wear surfaces 206, that is configured to dynamically engage another component, such as another wear part 200. Wear surfaces 206 additionally or alternatively may be referred to herein as bearing surfaces 206. When hardened case-nitrided metal article 100 is, or is included in, wear part 200, hardened case-nitrided metal article 100 defines at least one, and optionally each, wear surface 206 of wear part 200. In particular, surface 104 of hardened case-nitrided metal article 100 defines at least one, and optionally each, wear surface 206 of wear part 200, and nitrided case layer 106 extends beneath the at least one, and optionally each wear surface 206 of wear part 200. In some examples, the effective case depth 114 of hardened case-nitrided metal article 100 is at least substantially uniform or consistent across the plurality of wear surfaces 206 of wear part 200.

As further shown in FIG. 1, in some examples, hardened case-nitrided metal article 100 is, or is included in, a gear 202, which may be referred to herein as a hardened case-nitrided gear 202. Gear 202 includes a plurality of teeth 204 projecting radially outward about the circumference of the gear 202 and a plurality of troughs interposing the plurality of teeth. Each tooth 204 includes a plurality of wear surfaces 206 that engage with various other components, such as another gear 202, to transmit force or motion therebetween. In some examples, hardened case-nitrided metal article 100 defines each tooth 204, one or more wear surfaces 206, and/or the entirety of gear 202 such as discussed herein for wear part 200.

Traditionally, some metals and metal alloys have been excluded from use in certain wear parts owing to their inadequate hardness and thereby inability to adequately resist the various mechanisms of wear, such as those discussed above. As a more specific example, titanium and certain titanium alloys, including Ti-5553, typically cannot be utilized as or in many wear parts such as gears as a result of inadequate hardness. Even when case-nitrided, some metals and metal alloys, such as case-nitrided titanium, case-nitrided titanium alloys, and case-nitrided Ti-5553 typically possess inadequate hardness or inadequate case depth to be utilized as or in many wear parts, and more specifically gears.

By contrast, hardened case-nitrided metal articles 100, hardened case-nitrided titanium alloy articles 100, and/or hardened case-nitrided Ti-5553 articles 100 may possess sufficient hardness or effective case depth 114 to be utilized as or in such wear parts, and specifically gears. More generally, hardened case-nitrided metal articles 100, according to the present disclosure, may allow wear parts to be formed of metals and metal alloys that were not previously possible with traditional hardening techniques, such as nitriding alone. In particular, hardened case-nitrided metal articles 100, hardened case-nitrided titanium alloy articles 100, and/or hardened case-nitrided Ti-5553 articles according to the present disclosure may possess adequate hardness and/or adequate effective case depth to be sufficiently resistant to the above-discussed wear mechanisms and as such, to be utilized as or in wear parts. As a more specific example, hardened case-nitrided metal articles 100, hardened case-nitrided titanium alloy articles 100, and/or hardened case-nitrided Ti-5553 articles 100 may possess sufficient hardness and/or effective case depth 114 to be utilized in various aerospace applications that previously were not possible with components formed of corresponding metals or metal alloys and/or case-nitrided analogues thereof.

In some examples, the increased effective case depth 114 of hardened case-nitrided metal articles 100, hardened case-nitrided titanium alloy articles 100, and/or hardened case-nitrided Ti-5553 articles 100 prevents failures, such as via pitting, galling, etc., that otherwise would occur due to shallow case depths. In this way, hardened case-nitrided metal articles 100, hardened case-nitrided titanium alloy articles 100, and/or hardened case-nitrided Ti-5553 articles 100 may not fail, or fail as readily, via pitting, galling, etc. as would an otherwise equivalent case-nitrided metal article having a shallower case depth. In a more specific example, the effective case depth 114 of hardened case-nitrided metal articles 100, hardened case-nitrided titanium alloy articles 100, and/or hardened case-nitrided Ti-5553 articles 100 is greater than the spalling depth of the corresponding wear part 200, such as a gear. In such an example, a hardened case-nitrided gear 202, a hardened case-nitrided titanium alloy gear 202, and/or a hardened case-nitrided Ti-5553 gear 202, according to the present disclosure, may not fail via spalling as would an otherwise equivalent case-nitrided gear, an otherwise equivalent case-nitrided titanium alloy gear, and/or an otherwise equivalent case-nitrided Ti-5553 gear respectively.

FIG. 1 also illustrates examples of mechanical systems 300 that include a plurality of hardened case-nitrided wear parts 200 according to the present disclosure. In particular, mechanical systems 300 include at least two hardened case-nitrided wear parts 200 that are mechanically engaged with one another. In some examples, wear surfaces 206 of the hardened case-nitrided wear parts 200 dynamically engage with one another to transmit force or movement therebetween. In the particular example shown, mechanical system 300 includes at least two hardened case-nitrided gears 202 meshed with one another. In some examples, the two wear parts 200 or gears 202 are formed of a titanium alloy or Ti-5553. In other words, in some examples, mechanical systems 300 include at least two hardened case-nitrided titanium alloy wear parts 200 and/or at least two hardened case-nitrided Ti-5553 wear parts 200 mechanically engaged with one another. Likewise, in some examples, mechanical systems 300 include at least two hardened case-nitrided titanium alloy gears 202 and/or at least two hardened case-nitrided Ti-5553 gears 202 meshed with one another.

Figure 2:
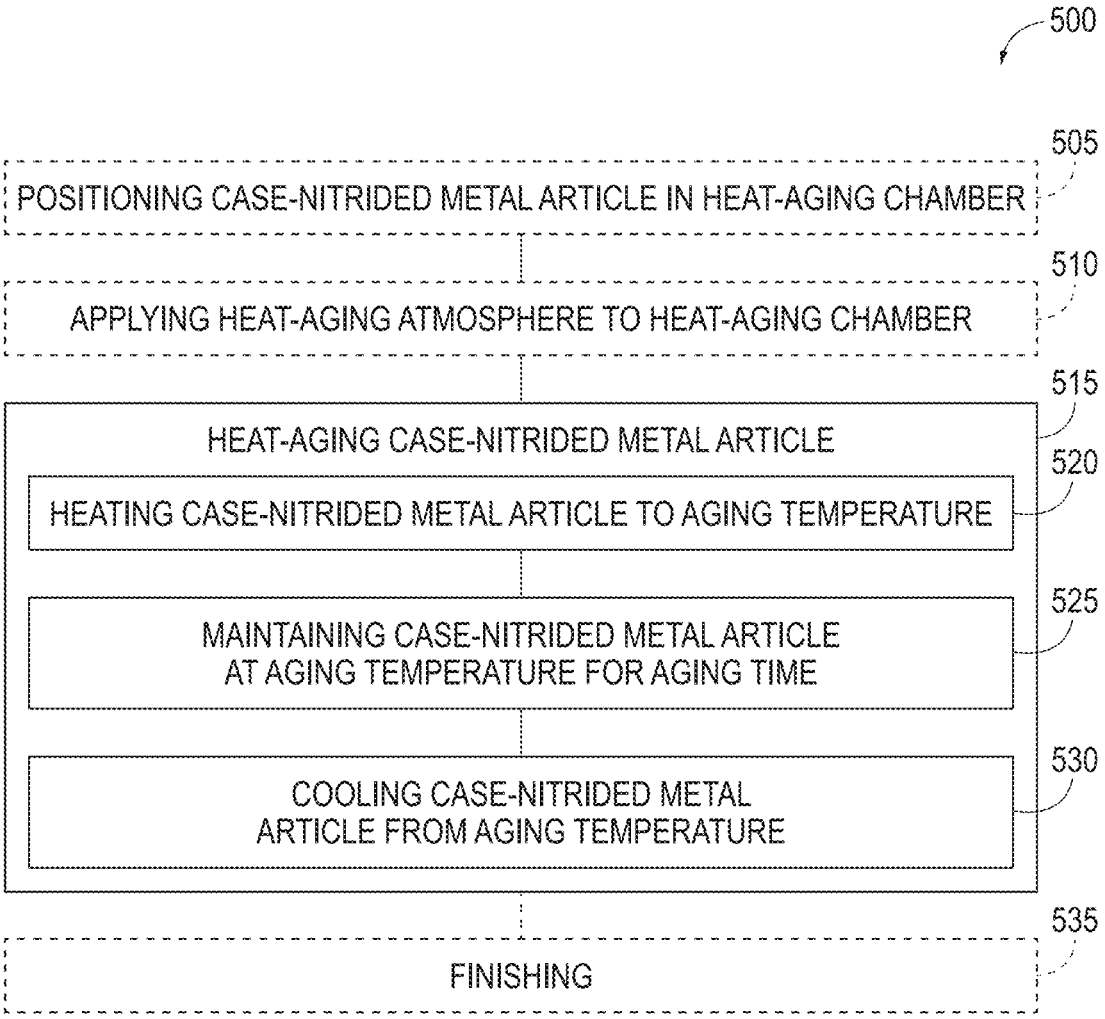
FIG. 2 is a flowchart schematically representing examples of methods of hardening a case-nitrided metal article according to the present disclosure.

In some examples, hardened case-nitrided metal articles 100, hardened case-nitrided wear parts 200, and/or hardened case-nitrided gears 202 illustrated and discussed herein with reference to FIG. 1 are produced, hardened, and/or formed by performing one or more of the methods illustrated and discussed herein with reference to FIGS. 2 and 4. In particular, methods 500 illustrated and discussed herein with reference to FIG. 2 may be utilized to harden case-nitrided metal articles, case-nitrided wear parts, and/or case-nitrided gears to produce the hardened case-nitrided metal articles 100, hardened case-nitrided wear parts 200, and/or hardened case-nitrided gears 202 illustrated and discussed herein with reference to FIG. 1. Similarly, methods 600 discussed herein with reference to FIG. 4 may be utilized to produce, form, and/or case-nitride and subsequently harden metal articles, wear parts, and/or gears to produce the hardened case-nitrided metal articles 100, hardened case-nitrided wear parts 200, and/or hardened case-nitrided gears 202 of FIG. 1.

FIG. 2 provides a flowchart that represents illustrative, non-exclusive examples of methods 500 according to the present disclosure. Methods 500 include hardening a case-nitrided metal article. In FIG. 2, some steps are illustrated in dashed boxes indicating that such steps may be optional or may correspond to an optional version of methods 500 according to the present disclosure. That said, not all methods 500 according to the present disclosure are required to include each of the steps illustrated in solid boxes. The methods and steps illustrated in FIG. 2 are not limiting, and other methods and steps are within the scope of the present disclosure, including methods having greater than or fewer than the number of steps illustrated, as understood from the discussions herein.

Figure 3:
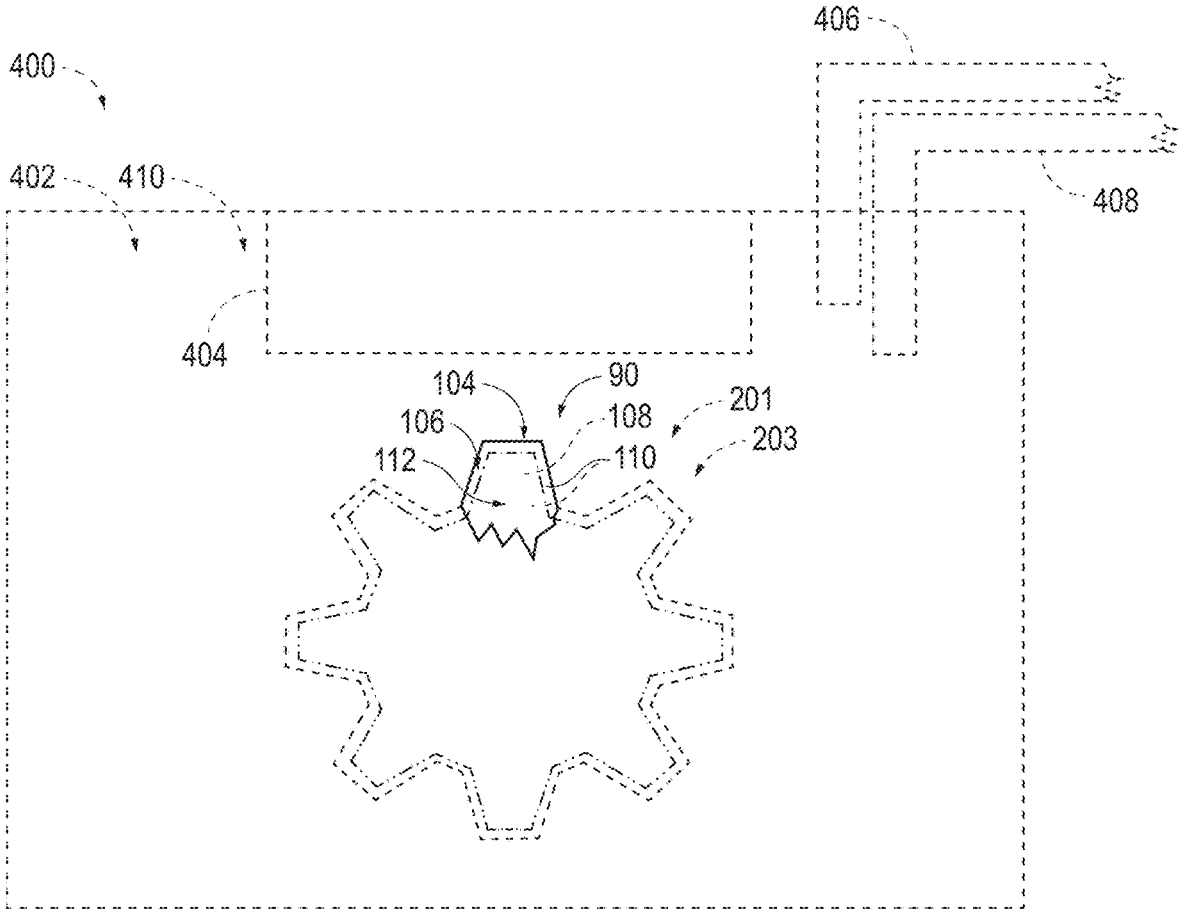
FIG. 3 is a schematic representation of an example heat-aging system that may be utilized to perform one or more steps of the methods of FIG. 2.

Methods 500 may include hardening case-nitrided metal articles 90, case-nitrided wear parts 201, and/or case-nitrided gears 203 to produce the hardened case-nitrided metal articles 100, the hardened case-nitrided wear parts 200, and/or the hardened case-nitrided gears 202 that are illustrated and discussed herein with reference to FIG. 1. Examples of case-nitrided metal articles 90, case-nitrided wear parts 201, and/or case-nitrided gears 203 are shown in FIG. 3. Thus, the hardened case-nitrided metal articles 100, the hardened case-nitrided wear parts 200, and/or the hardened case-nitrided gears 202 illustrated and discussed herein with reference to FIG. 1 may incorporate any of the features, functions, properties, components, etc., as well as variants thereof, as those discussed herein with reference to methods 500 and FIG. 2 without requiring the inclusion of all such features functions, components, etc. Likewise, the hardened case-nitrided metal articles 100, the hardened case-nitrided wear parts 200, and/or the hardened case-nitrided gears 202 produced by performing one or more steps of methods 500 may incorporate any of the features, functions, properties, components, etc., as well as variants thereof, as those discussed herein with reference to FIG. 1 without requiring the inclusion of all such features functions, components, etc.

As shown in FIG. 2, methods 500 include heat-aging a case-nitrided metal article at 515, which includes heating the case-nitrided metal article at 520, maintaining the case-nitrided metal article at the aging temperature for an aging time at 525, and cooling the case-nitrided metal article from the aging temperature at 530. In some examples, methods 500 include positioning the case-nitrided metal article in a heat-aging chamber at 505, applying a heat-aging atmosphere to the heat-aging chamber at 510, and/or finishing at 535.

Methods 500 are performed on any suitable case-nitrided metal article 90, such as one formed of any of the metals 108 or metal alloys 110 discussed herein. In some examples, the metal 108 or metal alloy 110 that forms the case-nitrided metal article is selected to be compatible with precipitation hardening. In some examples, the metal 108 or metal alloy 110 that forms the case-nitrided metal article is selected to be compatible with solution treatment and heat-aging. In some examples, the case-nitrided metal article is formed from a metal 108 or a metal alloy 110 that is compatible with case-nitriding.

In some examples, the case-nitrided metal article is a case-nitrided wear part and/or a case-nitrided gear. In some examples, the case-nitrided metal article is case-nitrided and/or formed by performing one or more of the steps of methods 600 as discussed in more detail herein. As referred to herein, a "case-nitrided" metal article refers to a metal article that has been case-nitrided, that has been taken through a case-nitriding process, and not necessarily a metal article that includes metal nitrides.

In some examples, methods 500 are performed utilizing a heat-aging system 400, illustrative non-exclusive examples of which are shown in FIG. 3. As shown in FIG. 3, heat-aging system 400 includes a heat-aging chamber 402 configured to receive at least one case-nitrided metal article 90, at least one case-nitrided wear part 201, and/or at least one case-nitrided gear 203. FIG. 3 illustrates an example of methods 500 prior to the heat-aging at 515, such that case-nitrided metal article 90 has not yet been hardened.

In some examples, heat-aging chamber 402 is configured to receive a plurality of case-nitrided metal articles 90. In some examples, heat-aging chamber 402 is sealable such as to prevent unwanted gasses from entering heat-aging chamber 402 during the heat-aging at 515. Heat-aging system 400 further includes a heating system 404 configured to heat the at least one case-nitrided metal article 90 positioned within the heat-aging chamber 402. Examples of suitable heat-aging systems 400 include resistive heating systems and/or inductive heating systems. In some examples, heat-aging system 400 includes a vacuum system 406 configured to evacuate, remove gas from, and/or reduce the pressure in heat-aging chamber 402. In some examples, heat-aging system 400 further includes an atmosphere supply system 408 configured to supply a heat-aging atmosphere to the heat-aging chamber, such as one or more inert gasses. Thus, in some examples, heat-aging system 400 is referred to as vacuum furnace.

As shown in FIG. 2, in some examples, methods 500 include positioning the case-nitrided metal article in a heat-aging chamber at 505. In some examples, the heat-aging chamber is the heat-aging chamber 402 of the heat-aging system 400 of FIG. 3. In some examples, methods 500 include hardening a plurality of case-nitrided metal articles at least substantially with one another. In such examples, the positioning at 505 comprises positioning a plurality of case-nitrided metal articles within the heat-aging chamber. In some examples, the positioning at 505 further includes enclosing and/or sealing the at least one case-nitrided metal article within the heat-aging chamber. In some examples, the positioning at 505 is performed prior to any other step of methods 500.

In some examples, methods 500 further include applying a heat-aging atmosphere to the heat-aging chamber at 510. In some examples, the applying at 510 comprises removing air, oxygen gas, and/or other potential contaminants from the heat-aging chamber 402. In some examples, the applying at 510 comprises evacuating or reducing the pressure of the heat-aging chamber 402, such as by utilizing vacuum system 406. Additionally or alternatively, in some examples, the applying at 510 comprises supplying one or more inert gasses, such as nitrogen gas and/or argon gas, to the heat-aging chamber 402, such as by utilizing the atmosphere supply system 408. In some examples, the applying at 510 includes pump-purging the heat-aging chamber or repeatedly evacuating and supplying the one or more inert gasses to the heat-aging chamber to thoroughly remove any air, oxygen, and/or other potential contaminants from the heat-aging chamber 402. In some examples, the applying at 510 includes applying a negative pressure to the heat-aging chamber 402 such as to seal the heat-aging pressure. As referred to herein, a negative pressure refers to a pressure that is less than a standard pressure, and/or less than an ambient pressure or the pressure of the atmosphere surrounding the heat-aging chamber. In a more specific example, the applying at 510 comprises evacuating the heat-aging chamber to a pressure of that is at least 80%, at least 90%, at most 90%, at most 95%, and/or at most 99% of the standard pressure.

In some examples, the applying at 510 comprises maintaining the heat-aging atmosphere during at least a portion of the heat-aging at 515 such as to prevent oxygen and/or other contaminates from entering the heat-aging chamber 402 during the heat-aging at 515. More specifically, in some examples, the maintaining is performed during the heating at 520, during the maintaining at 525, and optionally during the cooling at 530. In some examples, the applying at 510 comprises maintaining, during at least a portion of the heat-aging at 515, the heat-aging chamber 402 at the negative pressure and/or continually supplying the heat-aging atmosphere to the heat-aging chamber during the heat-aging 515.

When included, the applying at 510 is performed with any suitable sequence or timing within methods 500, such as subsequent to the positioning at 505, prior to the heat-aging at 515, and/or at least substantially simultaneously with the heat-aging at 515.

With continued reference to FIG. 2, methods 500 include heat-aging a case-nitrided metal article at 515. The heat-aging at 515 includes heating the case-nitrided metal article 90 to a heat-aging temperature at 520. In some examples, the heating at 520 includes heating the case-nitrided metal article 90 from room temperature. In other words, in some examples, the case-nitrided metal article 90 is at room temperature prior to the heating at 520. The heating at 520 includes heating at least a nitrided case layer 106 of the case-nitrided metal article to the heat-aging temperature and optionally includes heating a core 112 of the case-nitrided metal article 90 to the heat-aging temperature.

In some examples, the heating at 520 comprises directly heating the case-nitrided metal article 90 (e.g., via induction). Additionally or alternatively, in some examples, the heating at 520 comprises heating the atmosphere surrounding the case-nitrided metal article 90 to heat the case-nitrided metal article 90 to the heat-aging temperature. For some examples in which methods 500 include the positioning at 505, the heating at 520 comprises heating the case-nitrided metal article 90 with the heating system 404, such as directly or indirectly. In some such examples, the heating at 520 comprises heating the heat-aging atmosphere to heat the case-nitrided metal article to the heat-aging temperature.

The heat-aging temperature may be selected based upon the type of metal 108 or metal alloy 110 from which the case-nitrided metal article is formed. The heat-aging temperature is selected to be less than the melting point of the metal 108 or metal alloy 110 from which the case-nitrided metal article 90 is formed. In some examples, the heat-aging temperature is selected to be less than a nitriding temperature that is discussed in more detail herein.

In some examples, the heat-aging temperature is selected to be at least a threshold minimum temperature that is required to facilitate or induce microstructural changes within the nitrided case layer 106, and optionally the core, 112 that increase the hardness thereof. In some examples, the heat-aging temperature is, or is at least substantially similar to, the age-hardening, precipitation hardening, or particle hardening temperature of the metal 108 or metal alloy 110 from which the case-nitrided metal article 90 is formed. In some examples, the heat-aging temperature is less than the solution treatment temperature of the metal 108 or metal alloy 110 from which the case-nitrided metal article 90 is formed. In some examples, the heat-aging temperature is at least a minimum activation temperature for inducing precipitation within the nitrided case layer 106. As more specific examples, when the case-nitrided metal article 90 is formed of Ti-5553, the heat-aging temperature may be at least 300 degrees Celsius (° C.), at least 400° C., at least 450° C., at least 475° C., at least 500° C., at least 525° C., at least 535° C., at least 540° C., at least 560° C., at least 580° C., at least 600° C., at least 650° C., at most 525° C., at most 535° C., at most 540° C., at most 560° C., at most 580° C., at most 600° C., at most 650° C., at most 700° C., and/or at most 800° C.

The heating at 520 is performed with any suitable sequence or timing within methods 500, such as prior to the maintaining at 525, prior to the cooling at 530, subsequent to the positioning at 505, subsequent to the applying at 510, and/or at least substantially simultaneously with the applying at 510.

With continued reference to FIG. 2, the heat-aging at 515 further includes maintaining the case-nitrided metal article at the heat-aging temperature for a heat-aging time at 525. In some examples, the heat-aging time is selected based upon an amount of time at the heat-aging temperature that is required to facilitate, induce, and/or complete microstructural changes within the nitrided case layer, 106 and optionally the core, 112 that increase the hardness thereof. In some examples, the heat-aging time is selected based upon an amount of time that is required to facilitate, induce, and/or complete precipitation within the nitrided case layer 106 and optionally the core 112. In some examples, the heat-aging time is selected based upon the metal 108 or metal alloy 110 from which the case-nitrided metal article is formed, and/or based upon the size of the case-nitrided metal article. More specific examples of the heat-aging time include at least 1 hour, at least 2 hours, at least 3 hours, at least 4 hours, at least 5 hours, at least 6 hours, at least 7 hours, at least 8 hours, at least 9 hours, at least 10 hours, at least 12 hours, at most 8 hours, at most 9 hours, at most 10 hours, at most 12 hours, and/or at most 24 hours. As more yet more specific examples of the heat-aging time include at least 6 hours, at least 7 hours, at least 8 hours, at least 8.5 hours, at most 8 hours, at most 9 hours, and/or at most 10 hours for examples in which the case-nitrided metal article 90 is formed of Ti-5553.

The maintaining at 520 is performed with any suitable sequence or timing within methods 500, such as subsequent to the positioning at 505, subsequent to and/or at least substantially simultaneously with the applying at 510, subsequent to the heating at 520, and/or prior to the cooling at 530.

The heat-aging at 515 further includes cooling the case-nitrided metal article from the heat-aging temperature at 530. In some examples, the cooling at 530 comprises cooling the case-nitrided metal article to an ambient temperature or to room temperature. In some examples, the cooling at 530 comprises passively cooling and/or air cooling the case-nitrided metal article. In some such examples, the cooling at 530 comprises removing the case-nitrided metal article from heat-aging chamber 402 and placing the case-nitrided metal article 90 in an atmosphere that is at room temperature. Thus, in some examples, the cooling at 530 is performed with the case-nitrided metal article removed from the heat-aging atmosphere and/or under air. Alternatively, in some examples, the cooling at 530 is performed while the case-nitrided metal article 90 is within the heat-aging chamber 402, such as by turning off ceasing heating with the heating system 404 and permitting the case-nitrided metal article 90 to cool within the heat-aging chamber. In some examples, the cooling at 530 comprises rapidly cooling the case-nitrided metal article 90, such as by placing the case-nitrided metal article 90 in water.

The cooling at 530 is performed with any suitable sequence or timing within methods 500, such as subsequent to the maintaining at 525, subsequent to the applying at 510, and/or at least substantially simultaneously with the applying at 510.

When methods 500 include the positioning at 505, at least the heating 520 and the maintaining at 525, and optionally the cooling at 530, of the heat-aging at 515 is performed with the case-nitrided metal article positioned within the heat-aging chamber. Likewise, for some examples in which methods 500 include the applying at 510, at the least the heating at 520 and the maintaining at 525, and optionally the cooling at 530, of the heat-aging at 515 are performed with the case-nitrided metal article 90 within the heat-aging atmosphere.

As discussed herein, the case-nitrided metal article 90 includes a nitrided case layer 106 extending inwardly from the surface 104 of case-nitrided metal article towards the core 112 of the case-nitrided metal article 90. The heat-aging at 515 comprises increasing the hardness of the nitrided case layer 106. In other words, the heat-aging at 515 comprises producing a hardened case-nitrided metal article 100 from the case-nitrided metal article 90. Thus, subsequent to the heat-aging at 515, the case-nitrided metal article 90 is a hardened case-nitrided metal article 100. In some examples, the heat-aging at 515 comprises facilitating microstructural changes within the nitrided case layer that increase the hardness thereof. In some examples, the heat-aging at 515 comprises precipitation hardening the nitrided case layer. More specifically, in some examples, the heat-aging at 515 comprises forming precipitates within the nitrided case layer 106 that increase the hardness and/or yield strength thereof. In some examples, the heat-aging at 515 comprises increasing a wear resistance of the case-nitrided metal article, such that the resulting hardened case-nitrided metal article 100 includes an increased resistance to any of the wear mechanisms discussed herein.

In some examples, the heat-aging at 515 includes increasing the effective case depth of the nitrided case layer 106. More specifically, in some examples the heat-aging at 515 includes increasing the effective depth of the nitrided case layer 106 by at least one of least 0.25 mm, at least 0.45 mm, at least 0.5 mm, at least 0.55 mm, at least 0.6 mm, at least 0.65 mm, at least 0.7 mm, at most 0.8 mm, at most 0.9 mm, and/or at most 1 mm.

In some examples, the nitrided case layer 106 comprises a first hardness at a given depth within the nitrided case layer prior to the heat-aging at 515 and comprises a second hardness at the given depth within the nitrided case layer 106 subsequent to the heat aging at 515, in which the second hardness is greater than the first hardness. In some examples, the second hardness is a threshold fraction of the first hardness. Examples of the threshold fraction of the first hardness to the second hardness include at least 1.1, at least 1.2, at least 1.3, at least 1.4, at least 1.5, at least 1.6, at least 1.7, at most 1.2, at most 1.3, at most 1.4, at most 1.5, at most 1.6, at most 1.7, at most 1.8, at most 1.9, and/or at most 2.

In some examples, the heat-aging at 515 comprises increasing a core hardness of the core 112 of the case-nitrided metal article 90. In some examples, the heat-aging at 515 comprises precipitation hardening the core 112 of the case-nitrided metal article 90. In particular, in some examples, the core 112 of the case-nitrided metal article 90 includes a first core hardness prior to the heat-aging at 515 and comprises a second core hardness subsequent to the heat-aging at 515, in which the second core hardness is greater than the first core hardness. In some examples, the second core hardness is a threshold fraction of the first core hardness, with examples of the threshold fraction including at least 1.2, at least 1.3, at least 1.4, at least 1.5, at least 1.6, at least 1.7, at least 1.8, at most 1.5, at most 1.6, at most 1.7, at most 1.8, at most 1.9, and/or at most 2.

With continued reference to FIG. 2, in some examples, methods 500 include finishing at 535. In some examples, the finishing at 535 is performed subsequent to the heat-aging at 515. The finishing at 535 may comprise performing any one or more process steps to place the hardened case-nitrided metal article 100 in a condition for operable use. In a specific more example, a film of porous metal nitride, such as porous titanium nitride, is present on the surface 104 of the case-nitrided metal article 90 prior to the heat-aging at 515 and remains on the surface 104 of the case-nitrided metal article 90 subsequent to the heat-aging at 515. In some examples, the film of porous metal nitride should be removed from the surface 104 of the hardened case-nitrided metal article 100 before operable use of the hardened case-nitrided metal article 100. In such examples, the finishing at 535 comprises removing the film of porous metal nitride from the surface 104 of the hardened case-nitrided metal article 100. As more specific examples, the finishing at 535 may include one or more of polishing, sanding, milling, blasting, and/or etching the surface 104 of the hardened case-nitrided metal article 100 to remove the film of porous metal nitride therefrom.

FIG. 4 provides a flowchart that represents illustrative, non-exclusive examples of methods 600 according to the present disclosure. Methods 600 include methods of producing a hardened case-nitrided metal article 100. In FIG. 4, some steps are illustrated in dashed boxes indicating that such steps may be optional or may correspond to an optional version of methods 600 according to the present disclosure. That said, not all methods 600 according to the present disclosure are required to include each of the steps illustrated in solid boxes. The methods and steps illustrated in FIG. 4 are not limiting, and other methods and steps are within the scope of the present disclosure, including methods having greater than or fewer than the number of steps illustrated, as understood from the discussions herein.

Methods 600 may include producing the hardened case-nitrided metal articles 100, the hardened case-nitrided wear parts 200, and/or the hardened case-nitrided gears 202 that are illustrated and discussed herein with reference to FIG. 1. Thus, the hardened case-nitrided metal articles 100, the hardened case-nitrided wear parts 200, and/or the hardened case-nitrided gears 202 illustrated and discussed herein with reference to FIG. 1 may incorporate any of the features, functions, properties, components, etc., as well as variants thereof, as those discussed herein with reference to methods 600 and FIG. 2 without requiring the inclusion of all such features functions, components, etc. Likewise, the hardened case-nitrided metal articles 100, the hardened case-nitrided wear parts 200, and/or the hardened case-nitrided gears 202 produced by performing one or more steps of methods 600 may incorporate any of the features, functions, properties, components, etc., as well as variants thereof, as those discussed herein with reference to FIG. 1 without requiring the inclusion of all such features functions, components, etc.

As shown in FIG. 4, methods 600 include case-nitriding a metal article at 610 and hardening the case-nitrided metal article at 500. In some examples, the case-nitriding at 610 includes positioning the metal article in a nitriding chamber at 615, providing a nitriding atmosphere the nitriding chamber at 620, heating a portion of the metal article to a nitriding temperature at 625, maintaining the portion of the metal article at the nitriding temperature for a nitriding time at 630, and/or cooling the portion of the metal article from the nitriding temperature at 635. In some examples, methods 600 further include forming the metal article at 605, finishing the metal article at 640, and repeating at 645.

Methods 600 may be performed on any suitable metal article. More specifically, the metal 108 or metal alloy 110 which from the metal article is formed may be selected based upon the same factors as those discussed herein with reference to FIG. 1 and hardened case-nitrided metal articles 100 and/or FIG. 2 and methods 500. Likewise, in some examples, methods 600 are performed on a metal article that is, or is included, in a wear part and/or a gear such as discussed herein.

As shown in FIG. 4, in some examples, methods 600 include forming the metal article at 605. In some examples, the forming the metal article at 605 includes selecting the metal 108 or metal alloy 110 from which to form the metal article. In some examples, the forming at 605 comprises selecting the metal 108 or metal alloy 110 based upon any of the factors discussed herein. In some examples, the forming at 605 comprises forming a wear part from the metal 108 or metal alloy 110 and/or forming a gear from the metal 108 or metal alloy 110. In some examples, the forming at 605 comprises forming the metal 108 or metal alloy 110 into a desired shape, such as by casting, milling, cutting, additively manufacturing, and/or combinations thereof. In some examples, the desired shape is that of the wear part or gear. In some examples, the forming at 605 is preformed prior to any other step of methods 600.

Methods 600 include case-nitriding the metal article to produce a case-nitrided metal article at 610. In some examples, the metal article is a wear part or a gear, such that the case-nitriding at 610 includes case-nitriding a wear part to produce a case-nitrided wear part 201 therefrom and/or case-nitriding a gear to produce a case-nitrided gear 203 therefrom.

The case-nitriding at 610 includes case-nitriding the metal article via any suitable process. In some examples, the case-nitriding at 610 includes gas-nitriding the metal article. Additionally or alternatively, in some examples, the case-nitriding at 610 includes plasma nitriding the metal article. Examples of suitable methods by which the case-nitriding at 610 may be carried out as well as suitable apparatuses with which the case-nitriding at 610 may be performed are disclosed in U.S. Pat. No. 8,496,872; the entirety of which is incorporated herein by reference.

As shown in FIG. 4, in some examples, the case-nitriding at 610 includes positioning the metal article in a nitriding chamber at 615. In some examples, the nitriding chamber is included in a heating system that includes a heater, a gas delivery system, and a vacuum system. In such examples, the heating system is confined to heat the metal article, and optionally the nitriding chamber, the gas delivery system is configured to supply one or more gasses to the nitriding chamber, and the vacuum system is configured to evacuate the case-nitriding chamber.

In some examples, methods 600 include providing a nitriding atmosphere to the nitriding chamber at 620. In some examples, the providing at 620 is performed subsequent to the positioning at 615. In some examples, the providing at 620 comprises providing a nitrogen-containing gas to the nitriding chamber, such as by utilizing the gas delivery system. Examples of suitable nitrogen-containing gasses include nitrogen gas and ammonia gas. In some examples, the providing at 620 includes evacuating the nitriding chamber, such as by utilizing the vacuum system, and subsequently providing a nitrogen-containing gas to the nitriding chamber. In some examples, the evacuating comprises reducing the pressure of the nitriding chamber to be at most at least 0.01 Torr, at most 0.02 Torr, at most 0.5 Torr, and/or at most 1 Torr. In some examples, the evacuating is performed to remove air, oxygen gas, and/or any other potential contaminants from the nitriding chamber.

In some examples, the providing at 620 comprises pump-purging or repeatedly evacuating the nitriding chamber and supplying the nitrogen-containing gas to the nitriding chamber, such as at least 2 times, at least 3 times, at least 4 times, at least 5 times and/or at most 10 times. In some examples, the nitriding chamber is filled with the nitrogen-containing gas at a pressure of at least 600 Torr, least 700 Torr, at most 700 Torr, at most 750 Torr, and/or at most 760 Torr subsequent to the providing at 620. However, higher or lower pressures of the nitrogen-containing gas may be utilized without departing from the scope of the present disclosure. In some examples, the providing at 620 comprises maintaining the pressure of the nitrogen-containing gas within the nitriding chamber during heating at 625, maintaining at 630, and optionally during cooling at 635.

With continued reference to FIG. 4, in some examples, the case-nitriding at 610 includes heating a portion of the metal article to a nitriding temperature at 625. In some examples, the portion of the metal article extends from the surface 104 of the metal article to a selected depth from the surface 104. In some examples, the selected depth corresponds to the total case depth discussed herein and/or at least 0.25 mm or greater. In some examples, the portion of the metal article includes the entirety of the metal article. In some examples, the heating at 625 is performed with the metal article positioned within the nitriding chamber. In some examples, the heating at 625 comprises heating the metal article with the heater, such as by inductively heating the portion of the metal article and/or by heating the nitriding atmosphere to heat the portion of the metal article.

The nitriding temperature may be selected based upon the type of metal 108 or metal alloy 110 from which the metal article is formed. In some examples, the nitriding temperature is a threshold fraction of a melting point of the metal 108 or metal alloy 110 from which the metal article is formed, such as in the range of at least 60% to at most 99% of the melting point of the metal 108 or metal alloy 110. In some examples, the nitriding temperature is selected to be within a solution treatment temperature range of the metal 108 or metal alloy 110. In particular, for some examples in which the metal article is formed of ferrous metal alloys, the nitriding temperature is selected to be within the austenitizing or solution treatment temperature range for the particular ferrous metal alloy. Similarly, for some examples in which the metal article is formed of a titanium alloy, the nitriding temperature is selected to be within the solution treatment temperature of the particular titanium alloy.

As more specific examples, when the metal article is formed of titanium, the nitriding temperature is in the range of 1,000° C. to 1,600° C. For examples in which the metal article is formed of Ti-5553, the nitriding temperature is at least 1,000 degrees ° C., at least 1,100° C., at least 1,200° C., at least 1,300° C., at least 1,325° C., at least 1,350° C., at least 1,375° C., at least 1400° C., at least 1,425° C., at least 1,450° C., at least 1,475° C., at least 1,500° C., at least 1,525° C., at most 1,325° C., at most 1,350° C., at most 1,375° C., at most 1,400° C., at most 1,425° C., at most 1,450° C., at most 1,475° C., at most 1,500° C., at most 1,525° C., and/or at most 1,600° C.

In some examples, the case-nitriding at 610 further comprises maintaining the portion of the metal article at the nitriding temperature for a nitriding time. In some examples, the nitriding time is selected based upon the particular type of nitriding process, a desired total case depth of the nitrided case layer, and/or the type of metal 108 or metal alloy 110 from which the metal article is formed. Examples of suitable nitriding times include at least 3 minutes, at least 5 minutes, at least 8 minutes, at least 10 minutes, at least 15 minutes, at least 20 minutes, at most 8 minutes, at most 10 minutes, at most 15 minutes, at most 20 minutes, at most 30 minutes, and at most 40 minutes. As yet more specific examples, for some examples in which the metal article is formed of Ti-5553 and the heating at 625 and the maintaining at 630 is performed with an induction heater or via induction heating, the nitriding time is at least one of at least 4 minutes, at least 5 minutes, at least 8 minutes, at most 8 minutes, at most 10 minutes, and/or at most 12 minutes.

When included in the case-nitriding at 610, the maintaining at 630 is performed subsequent to the heating at 625 and prior to the cooling at 635.

With continued reference to FIG. 4, in some examples, the case-nitriding at 610 includes cooling the portion of the metal article from the nitriding temperature to a reduced temperature at 635. When included, the cooling at 635 is performed subsequent to the heating at 625 or the maintaining at 630, and prior to the hardening at 500. In some examples, the reduced temperature is lower than the heat aging temperature discussed herein. Additionally or alternatively, in some examples, the reduced temperature is room temperature, with more specific examples of the room temperature including at least 15° C., at least 18° C., at least 20° C., at most 20° C., at most 25° C., and/or at most 30° C.

For some examples in which the heating at 625 and/or the maintaining at 630 are performed in the nitriding chamber, the cooling at 635 comprises removing the metal article from the nitriding chamber and/or at least a portion of the cooling at 635 is performed with the metal article removed from the nitriding chamber. In some examples, the cooling at 635 is performed at a rate that is selected based upon the metal 108 or metal alloy 110 from which the metal article is formed and/or based upon the nitriding temperature. In some examples, the cooling at 635 comprises cooling the portion of the metal article at a rate that is equivalent to or faster than air-cooling. In some such examples, the cooling at 635 includes air-cooling the metal article such as discussed herein. In other such examples, the cooling at 635 includes quenching in water or placing the metal article in a body of water. In such examples, the cooling at 635 comprises rapidly cooling the portion of the metal article at a rate that is faster than air-cooling.

Regardless of the particular type of nitriding performed and/or the particular combination of steps included in the case-nitriding at 610, the case-nitriding at 610 comprises diffusing nitrogen into the case of the metal article to form one or more nitrogen-containing phases therein. As such, in each example, the case-nitriding at 610 comprises forming the nitrided case layer 106 in the metal article. Additionally, the case-nitriding at 610 comprises hardening the case and the surface of the metal article. Thus, subsequent to the case-nitriding at 610, the metal article may be referred to herein as a case-nitrided metal article 90.

With continued reference to FIG. 4, methods 600 further include hardening the case-nitrided metal article to produce a hardened case-nitrided metal article at 500. The hardening at 500 comprises performing any of the methods 500 that are illustrated and discussed herein with reference to FIG. 2 on the case-nitrided metal article 90 produced during the case-nitriding at 610. In particular, the hardening at 500 includes performing any suitable combination of the steps of methods 500 that are illustrated in discussed herein with reference to FIG. 2 to harden the case-nitrided metal article 90.

The hardening at 500 is performed subsequent to the case-nitriding at 610. Thus, for examples in which the case-nitriding at 610 includes cooling at 635, the hardening at 500 is performed subsequent to the cooling at 635. In this way, the heating at 520 of the hardening at 500 includes heating the case-nitrided metal article from the reduced temperature.

As discussed herein, the hardening at 500 includes increasing the hardness of the nitrided case layer 106 of the case-nitrided metal article 90, and optionally increasing the hardness of the core 112 of the case-nitrided metal article 90. As such, the hardening at 500 may include hardening the case-nitrided metal article 90 produced during the case-nitriding at 610 in any manner to that discussed herein with reference to FIGS. 2-3. Thus, prior to the hardening at 500, the case-nitrided metal article 90 may include any of the features, properties, etc. to those discussed herein with reference to methods 500 and FIGS. 2-3, and subsequent to the hardening at 500 the hardened case-nitrided metal article 100 may include any of the features, properties, etc. to those discussed herein with reference to methods 500 and FIG. 2 and/or those discussed herein with reference to FIG. 1.

In some examples, each step of methods 600 is performed by a single entity or party. In other examples, two or more steps of methods 500 are performed by two or more different entities or parties. For example, the case-nitriding at 610 and the hardening at 500 may be performed by the same entity or party, such as in the same factory, manufacturing environment and/or utilizing the same apparatus. In other examples, the case-nitriding at 610 and the hardening at 500 are performed by separate entities or parties, such as in separate factories, manufacturing environments, and/or apparatuses.

Further, it is within the scope of the present disclosure that methods 600 are performed with any suitable duration of time separating the case nitriding at 610 and the hardening at 500. In some examples, the hardening at 500 is performed immediately after, or as soon as possible after, the case-nitriding at 610, such as immediately after, or as soon as possible after, the case-nitrided metal article 90 is cooled to the reduced temperature. Alternatively, in some examples, the hardening at 500 is performed a significant time after the case-nitriding at 610. More specifically, in some examples, the hardening at 500 is performed hours, days, weeks, months, and/or even years after the case-nitriding at 610.

For examples in which the case-nitriding at 610 comprises case-nitriding the wear part to produce a case-nitrided wear part 201, the hardening at 500 comprises hardening the case-nitrided wear part 201 to produce a hardened case-nitrided wear part 200, such as discussed herein. Likewise, for examples in which the case-nitriding at 610 comprises case-nitriding the gear to produce a case-nitrided gear 203, the hardening at 500 comprises hardening the case-nitrided gear 203 to produce a hardened case-nitrided gear 202, such as discussed herein.

As shown in FIG. 4, in some examples, methods 600 further include finishing at 640. In some examples, the finishing at 640 is performed subsequent to the case-nitriding at 610 and prior to the hardening at 500. In such examples, the finishing at 640 comprises finishing the case-nitrided metal article 90. Additionally or alternatively, in some examples, the finishing at 640 is performed subsequent to the hardening at 500. In such examples, the finishing at 640 additionally or alternatively comprises finishing the hardened case-nitrided metal article 100. The finishing at 640 may comprise performing any one or more process steps to place the case-nitrided metal article 90 or hardened case-nitrided metal article 100 in a condition for operable use. In a more specific example, a film of porous metal nitride, such as porous titanium nitride is formed along the surface 104 of the metal article during the case-nitriding at 610. In some examples, the film of porous metal nitride should be removed from the surface 104 of the case-nitrided metal article 90 or the hardened case-nitrided metal article 100 before operable use of the hardened case-nitrided metal article 100. In such examples, the finishing at 640 comprises removing the film of porous metal nitride from the surface 104 of the case-nitrided metal article 90 or the hardened case-nitrided metal article 100. As more specific examples, the finishing at 640 may include one or more of polishing, sanding, milling, blasting, and/or etching the surface 104 of the one of the hardened case-nitrided metal article 100 and/or the surface 104 of the case-nitrided metal article 90 to remove the film of porous metal nitride therefrom.

As further shown in FIG. 4, methods 600 optionally include repeating at 645. When included, the repeating at 645 comprises repeating any suitable combination of one or more steps of methods 600. In some examples, the repeating at 645 is performed to produce a plurality of hardened case-nitrided metal articles 100, a plurality of hardened case-nitrided wear parts 200 and/or a plurality of hardened case-nitrided gears 202. In some such examples, the repeating at 645 included repeating the forming at 605 a plurality of times to produce a plurality of metal articles and subsequently repeating the case-nitriding at 610 a plurality of times to case-nitride the plurality of metal articles and produce a plurality of case-nitrided metal articles 90 therefrom. In some examples, the hardening at 500 includes hardening the plurality of case-nitrided metal articles 90 produced during the repeating the case-nitriding at 610 at least substantially simultaneously with one another. In other examples, the repeating at 645 comprises repeating the hardening at 500 a plurality of times to harden each case-nitrided metal article 90 individually or repeating the hardening at 500 a fewer plurality of times to harden the plurality of case-nitrided metal articles in subsets or groups.

Now with reference to FIG. 5, an illustration of a Table 700 is provided that includes the test results from a case-nitriding and hardening procedure carried out on Ti-5553 rods. In particular, FIG. 5 demonstrates the test results produced by a specific, non-exclusive example of methods 600 for case-nitriding and hardening the Ti-5553 Rods. The hardening procedure for the test results demonstrated in Table 700 was performed in a specific, non-exclusive example of the heat-aging system 400 that is illustrated and discussed herein with reference to FIG. 3.

As depicted, Table 7 includes the Test results: Test 1, Test 2, Test 3, Test 4, Test 5, Test 6, Test 7, Test 8, Test 9, and Test 10. Each Test result was gathered from a 0.5-inch diameter cylindrical Ti-5553 Rod. Test 1, Test 3, Test 5, Test 7, and Test 9 include measurements of Ti-5553 Rods that were case-nitrided, while Test 2, Test 4, Test 6, Test 8, and Test 10 include the Test results of Ti-5553 Rods that were case-nitrided and subsequently hardened.

Figure 7:
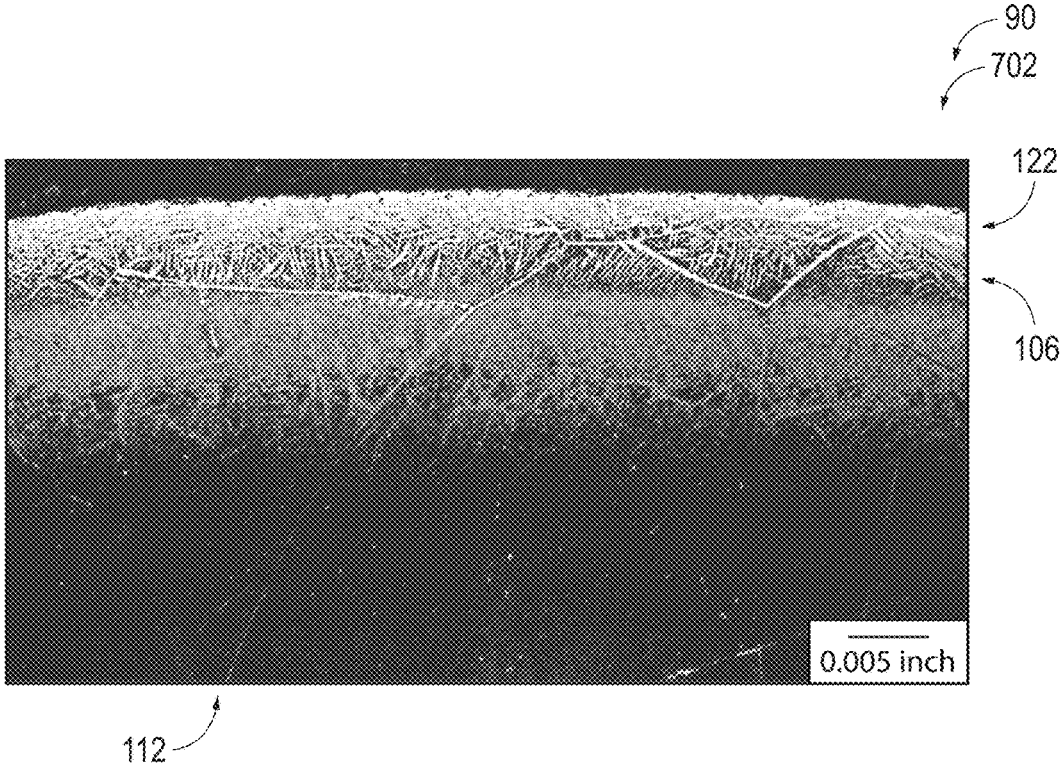
FIG. 7 is a micrograph of a metallurgical cross-section through an example hardened case-nitrided Ti-5553 article that was case-nitrided at the first nitriding temperature and subsequently hardened.

The Test results depicted in FIG. 7 reflect measurements taken on a total of five Ti-5553 Rods: Rod 702, Rod 704, Rod 706, Rod 708, and Rod 710. Case-nitriding of each Ti-5553 Rod was conducted in a Gleeble machine that includes a sealing nitriding chamber, a vacuum system for evacuating the nitriding chamber, a gas delivery system for supplying nitrogen gas to the nitriding chamber, and an induction coil within the nitriding chamber that was utilized to inductively heat each Ti-5553 Rod. Case-nitriding of each Ti-5553 Rod was carried out individually according to the following general procedure. The Rod was positioned within the internal diameter of the induction coil and the nitriding chamber was sealed. The pressure of the nitriding chamber then was reduced with the vacuum system to a pressure of 0.5 Torr, and ultra-high purity (UHP) grade nitrogen gas was supplied to the nitriding chamber to bring the pressure therein to just below atmospheric or standard pressure. The evacuation and nitrogen supplying procedure (i.e., pump-purge) was repeated five times, and the pressure of the nitriding chamber was brought to just below atmospheric pressure with the UHP nitrogen at the end of the fifth cycle. After the fifth pump-purge cycle, the Rod was heated with the induction coil to a selected nitriding temperature, and the temperature of the Rod was monitored using an optical pyrometer. The Rod was heated at an initial ramp rate of 50° C. per second until the temperature of the Rod reached 100° C. below the selected nitriding temperature, at which point the ramp rate was reduced to 10° C. per second until the temperature of the Rod reached the selected nitriding temperature. Each Rod was maintained at the nitriding temperature for 10 minutes, subsequently removed from the nitriding chamber, and allowed to come to room temperature by air-cooling.

During the case-nitriding, Rod 702 was heated to and maintained at a nitriding temperature of 1,325° C., Rod 704 was heated to and maintained at a nitriding temperature of 1,375° C., Rod 706 was heated to and maintained at a nitriding temperature of 1,425° C., Rod 708 was heated to and maintained at a nitriding temperature of 1,475° C., and Rod 710 was heated and maintained at a nitriding temperature of 1,500° C.

After cooling to room temperature, each Rod was mechanically sectioned radially at its longitudinal center for pre-hardening and post-hardening evaluation. In particular, one half of each Rod was saved for testing the effects of the nitriding process alone. The other half of each Rod subsequently was hardened according to the following procedure. The five Rod halves were placed in a vacuum furnace, and the vacuum furnace was closed. The pressure within the closed vacuum furnace then was reduced to just below atmospheric pressure to ensure that the vacuum furnace remained sealed during the hardening. The Rod halves then were heated to 593.3° C. within the vacuum furnace and maintained at 593.3° C. for 8.5 hours. The vacuum furnace and the Rods then were allowed to passively cool to room temperature and the Rods were removed for testing.

After the above-discussed treatment, metallographic cross-sections were taken through each Rod half for microhardness traverses (measured in HRC) and corresponding effective case depth (ECD) determination. Core hardness measurements (measured in HRC) were performed at the center of each Rod half, and surface hardness (measured in HRN 15N) were performed on the outer diameter of each Rod half. Metallurgical examination revealed a film of porous titanium nitride on the surface of each Rod half, which ranged from 0.001 inches in depth for Rod 702 to 0.0064 inches for Rod 710. To avoid the titanium nitride layer, all microhardness traverses were initiated approximately 0.003 inches from the bottom of the titanium nitride layer.

In Table 700, the Tests demonstrate the hardness measured for each Rod before and after hardening at a series of depths between 0.003-0.055 inches from the surface of the Rod. Table 7 also demonstrates the effective case depth as defined herein, the core hardness, the surface hardness, and the thickness of the porous titanium nitride layer of each Rod before and after hardening. In Table 7, all depths and thicknesses are reported in inches, surface hardness was measured and is reported in HRN 15N, and all other hardnesses were measured and are reported in HRC.

Test 1 includes these measurements for Rod 702 prior to hardening and Test 2 includes these measurements for Rod 702 subsequent to hardening. In other words, Test 1 includes measurements taken on the half of Rod 702 that was not hardened, and Test 2 includes measurements taken on the half of Rod 702 that was hardened. Test 3 includes these measurements for Rod 704 prior to hardening and Test 4 includes these measurements for Rod 704 subsequent to hardening. Test 5 includes these measurements for Rod 706 prior to hardening and Test 6 includes these measurements for Rod 706 subsequent to hardening. Test 7 includes these measurements for Rod 708 prior to hardening and Test 8 includes these measurements for Rod 708 subsequent to hardening. Test 9 includes these measurements for Rod 710 prior to hardening and Test 10 includes these measurements for Rod 710 subsequent to hardening.

As shown in Table 700, the hardening process increased the hardness of each Rod at depths between 0.003-0.055 inches from the surface by at least 5 HRC and as much as 18 HRC. All Rod halves that were not hardened subsequent to the case-nitriding process failed to reach the desired effective case depth, while the Rods halves that were hardened subsequent to the case-nitriding process demonstrated effective case depths in the range of 0.011 inches to 0.0274 inches, with the effective case depth increasing along with the nitriding temperature. The case-nitrided and hardened Rod halves also exhibited increased core hardness as compared to the non-hardened counterparts.

Figure 6:
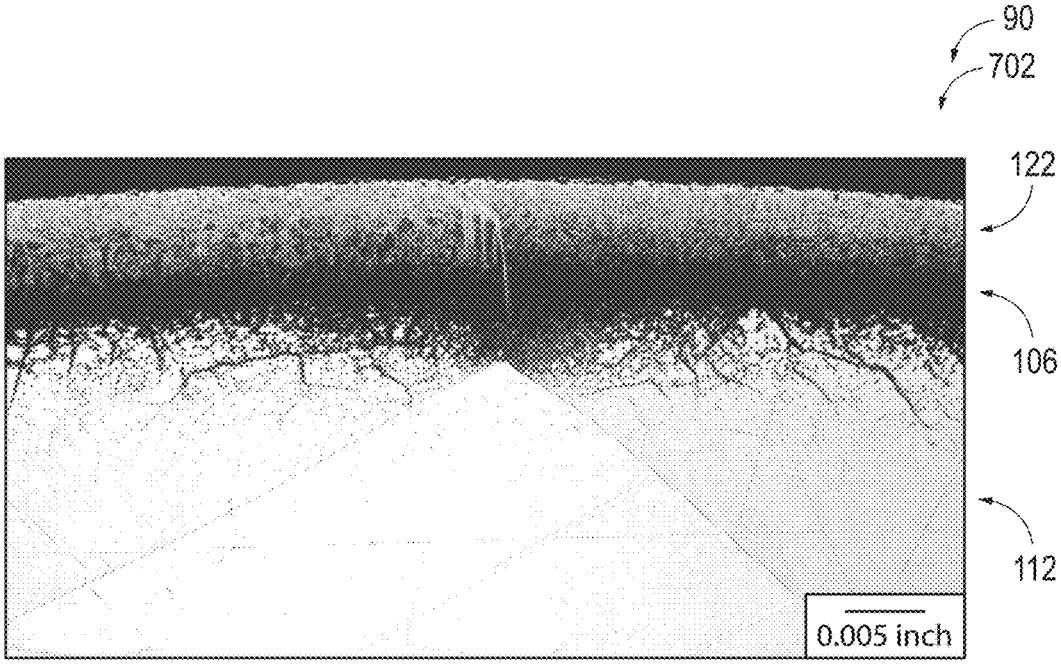
FIG. 6 is a micrograph of a metallurgical cross-section through an example case-nitrided Ti-5553 article that was case-nitrided at a first nitriding temperature.
Figure 8:
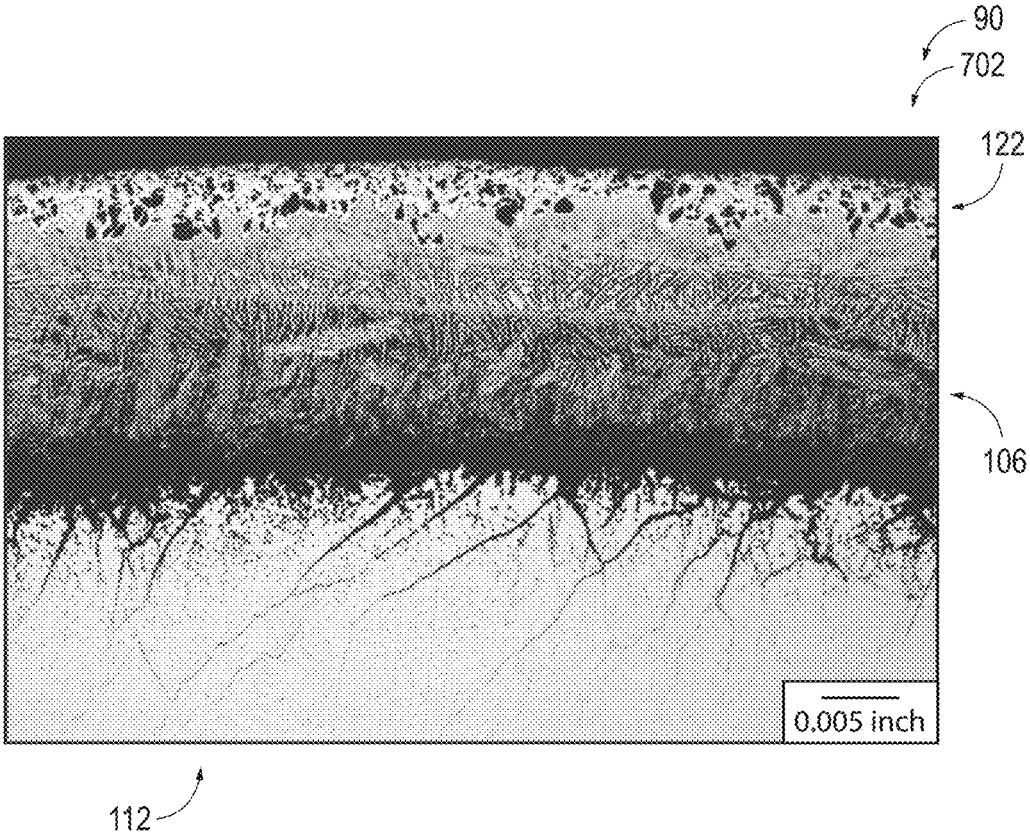
FIG. 8 is a micrograph of a metallurgical cross-section through an example case-nitrided Ti-5553 article that was case-nitrided at a second nitriding temperature.
Figure 9:
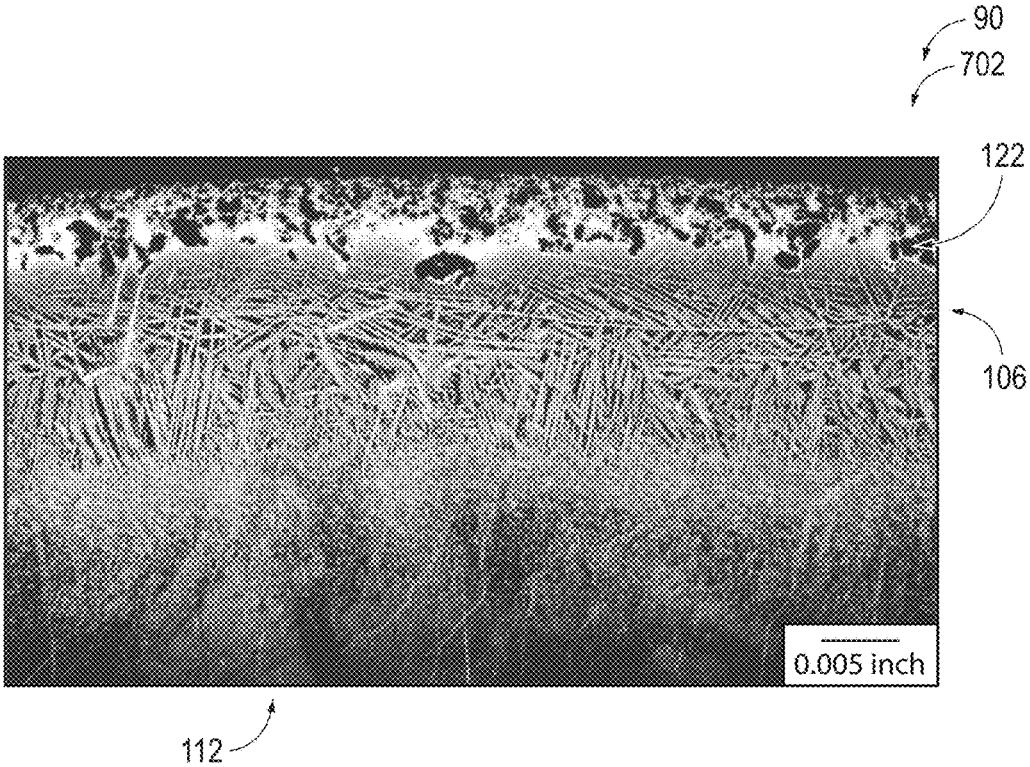
FIG. 9 is a micrograph of a metallurgical cross-section through an example hardened case-nitrided Ti-5553 article that was case-nitrided at the second nitriding temperature and subsequently hardened.

Turning to FIGS. 6-9, illustrated therein are micrographs of metallurgical cross-section through Rod 702 and Rod 710 prior to and subsequent to hardening. Each micrograph shown in FIGS. 6-9 shows the nitrided case layer 106 surrounding the core 112, and a film of porous titanium nitride 122 atop the nitrided case layer 106. More specifically, FIG. 6 is micrograph of a metallurgical cross section through Rod 702 subsequent to nitriding and prior to hardening, and FIG. 7 is a metallurgical cross-section through Rod 702 subsequent to hardening. FIG. 8 is micrograph of a metallurgical cross-section through Rod 710 subsequent to case-nitriding and prior to hardening, and FIG. 9 is a metallurgical cross-section through Rod 710 subsequent to the hardening. Thus, FIGS. 6 and 8 provide examples of case-nitrided metal articles 90 and more specifically case-nitrided Ti-5553 articles, while FIGS. 7 and 9 provide examples of corresponding hardened case-nitrided metal articles 100, and more specifically hardened case-nitrided Ti-5553 articles 100.

Illustrative, non-exclusive examples of inventive subject matter according to the present disclosure are described in the following enumerated paragraphs:

A. A method (500) of hardening a case-nitrided metal article (90), the method (500) comprising:

heat-aging (515) the case-nitrided metal article (90), wherein the heat-aging (515) comprises:

heating (520) the case-nitrided metal article (90) to an aging temperature;

maintaining (525) the case-nitrided metal article (90) at the aging temperature for an aging time; and cooling (530) the case-nitrided metal article (90) from the aging temperature.

A1. The method (500) of paragraph A, further comprising positioning (505) the case-nitrided metal article (90) within a heat-aging chamber (402).

A1.1. The method (500) of paragraph A1, wherein the heat-aging (515) is performed with the case-nitrided metal article (90) positioned within the heat-aging chamber (402).

A1.2. The method (500) of any of paragraphs A1-A1.1, wherein the heating (520) comprises increasing a temperature of the heat-aging chamber (402) to the aging temperature.

A1.3. The method (500) of any of paragraphs A1-A1.2, further comprising applying (510) a heat-aging atmosphere to the heat-aging chamber (402).

A1.3.1. The method (500) of paragraph A1.3, wherein the applying (510) the heat-aging atmosphere comprises evacuating the heat-aging chamber (402) and subsequently supplying the heat-aging atmosphere to the heat-aging chamber (402).

A1.3.2. The method (500) of any of paragraphs A1.3-A1.3.1, wherein the applying (510) comprises removing oxygen gas from the heat-aging chamber (402).

A1.3.3. The method (500) of any of paragraphs A1.3-A1.3.2, wherein the applying (510) the heat-aging atmosphere comprises supplying an inert gas to the heat-aging chamber (402).

A1.3.3.1. The method (500) of paragraph A1.3.3, wherein the inert gas is one or more of nitrogen gas and/or argon gas.

A1.3.4. The method (500) of any of paragraphs A1.3-A1.3.3.1, wherein the applying (510) further comprises maintaining the heat-aging atmosphere in the heat-aging chamber (402) during the heat-aging (515).

A1.3.5. The method (500) of any of paragraphs A1.3-A1.3.4, wherein the applying (510) comprises applying a negative pressure to the heat-aging chamber (402), and wherein the maintaining comprises maintaining the negative pressure in the heat-aging chamber (402) during the heat-aging (515).

A2. The method (500) of any of paragraphs A-A1.3.5, wherein the heating (520) comprises heating the case-nitrided metal article (90) from room temperature.

A3. The method (500) of any of paragraphs A-A2, wherein the heat-aging temperature is at least 300 degrees Celsius (° C.), at least 400° C., at least 450° C., at least 475° C., at least 500° C., at least 525 °C, at least 535° C., at least 540° C., at least 550° C., at least 560° C., at least 580° C., at least 600° C., at least 650° C., at most 525° C., at most 535° C., at most 540° C., at most 560° C., at most 580° C., at most 600° C., at most 650° C., at most 700° C., and/or at most 800° C.

A3.1. The method (500) of any of paragraphs A-A3, wherein the aging time is at least one of at least 1 hour, at least 2 hours, at least 3 hours, at least 4 hours, at least 5 hours, at least 6 hours, at least 7 hours, at least 8 hours, at least 9 hours, at least 10 hours, at least 12 hours, at most 8 hours, at most 9 hours, at most 10 hours, at most 12 hours, and/or at most 24 hours.

A4. The method (500) of any of paragraphs A-A3.1, wherein the case-nitrided metal article (90) includes a nitrided case layer (106) that extends inwardly from a surface (104) of the case-nitrided metal article (90) towards a core (112) of the case-nitrided metal article (90), and wherein the heat-aging (515) comprises increasing an effective case depth (114) of the nitrided case layer (106).

A4.1. The method (500) of paragraph A4, wherein the heat-aging (515) comprises increasing the effective case depth (114) of the nitrided case layer (106) by at least one of least 0.25 millimeters (mm), at least 0.45 mm, at least 0.5 mm, at least 0.55 mm, at least 0.6 mm, at least 0.65 mm, at least 0.7 mm, at most 0.8 mm, at most 0.9 mm, and at most 1 mm.

A4.2. The method (500) of any of paragraphs A4-A4.1, wherein the nitrided case layer (106) comprises a first hardness at a given depth within the nitrided case layer (106) prior to the heat-aging (515) and a second hardness at the given depth within the nitrided case layer (106) subsequent to the heat-aging (515), and wherein the second hardness is greater than the first hardness.

A4.2.1. The method (500) of paragraph A4.2, wherein the second hardness is a threshold fraction of the first hardness, and wherein the threshold fraction of the second hardness to the first hardness is at least one of at least 1.1, at least 1.2, at least 1.3, at least 1.4, at least 1.5, at least 1.6, at least 1.7, at most 1.2, at most 1.3, at most 1.4, at most 1.5, at most 1.6, at most 1.7, at most 1.8, at most 1.9, and/or at most 2.

A4.3. The method (500) of any of paragraphs A4-A4.2, wherein the heat-aging (515) comprises precipitation hardening the nitrided case layer (106).

A5. The method (500) of any of paragraphs A-A4.3, wherein the heat-aging (515) includes increasing a core hardness of a/the core (112) of the case-nitrided metal article (90).

A5.1. The method (500) of paragraph A5, wherein the core (112) of the case-nitrided metal article (90) comprises a first core hardness prior to the heat-aging (515), wherein the core (112) of the case-nitrided metal article (90) comprises a second core hardness subsequent to the heat-aging (515), wherein the first core hardness and the second core hardness are measured at a core depth from a surface (104) of the case-nitrided metal article (90), and wherein the second core hardness is greater than the first core hardness.

A5.1.1. The method (500) of paragraph A5.1, wherein the second core hardness is a threshold fraction of the first core hardness, and wherein the threshold fraction is at least 1.2, at least 1.3, at least 1.4, at least 1.5, at least 1.6, at least 1.7, at least 1.8, at most 1.5, at most 1.6, at most 1.7, at most 1.8, at most 1.9, and at most 2.0.

A6. The method (500) of any of paragraphs A-A5.1.1, wherein the case-nitrided metal article (90) is formed of at least one of a metal, an elemental metal, a metal alloy, a precipitation-hardening metal, a precipitation-hardening metal alloy, an iron alloy, a steel, stainless steel, a titanium alloy, a Ti—Al—V—Mo—Cr alloy, Ti-5553, a Ti-A1-V alloy, and/or Ti-64.

A6.1 The method (500) of paragraph A6, wherein the case-nitrided metal article (90) is formed of a titanium alloy.

A6.1.1 The method (500) of paragraph A6.1, wherein the case-nitrided metal article (90) is formed of Ti-5553.

A7. The method (500) of any of paragraph A-A6.1.1, wherein the case-nitrided metal article (90) is formed from a metal (108) or a metal alloy (110) that is selected to be compatible with solution treatment and aging.

A8. The method (500) of any of paragraphs A-A7, wherein the case-nitrided metal article (90) is formed from a metal (108) or a metal alloy (110) that is that is compatible with case-nitriding.

A9. The method (500) of any of paragraphs A-A8, wherein the heat-aging (515) comprises increasing a wear resistance of the case-nitrided metal article (90).

A10. The method (500) of any of paragraphs A-A9, wherein, subsequent to the heat-aging (515), the case-nitrided metal article (90) is a hardened case-nitrided metal article (100).

A11. The method (500) of any of paragraphs A-A10, wherein the case-nitrided metal article (90) is a case-nitrided wear part (201), and wherein the heat-aging (515) comprises producing a hardened case-nitrided wear part (200) from the case-nitrided wear part (201).

A11.1 The method (500) of paragraph A11, wherein the method (500) includes increasing a/the wear resistance of the case-nitrided wear part (201).

B. A method (600) of producing a hardened case-nitrided metal article (100), the method (600) comprising:

case-nitriding (610) a metal article to produce a case-nitrided metal article (90), wherein the metal article is formed of a metal (108) or a metal alloy (110); and hardening (500) the case-nitrided metal article (90), wherein the hardening (500) comprises performing the method (500) of any of paragraphs A-A11.1 on the case-nitrided metal article (90) to produce the hardened case-nitrided metal article (100) therefrom.

B1. The method (600) of paragraph B, wherein the case-nitriding (610) comprises at least one of gas nitriding the metal article and plasma nitriding the metal article.

B2. The method (600) of any of paragraphs B-B1, wherein the case-nitriding (610) comprises heating (625) a portion of the metal article to a nitriding temperature, and wherein the method (600) further comprises cooling (635) the portion of the metal article from the nitriding temperature to a reduced temperature subsequent to the case-nitriding (610) and prior to the hardening (500).

B2.1. The method (600) of paragraph B2, wherein the reduced temperature is less than the heat-aging temperature.

B2.1.1 The method (600) of paragraph B2.1, wherein the reduced temperature is room temperature.

B2.2 The method (600) of any of paragraphs B2-B2.1.1, wherein the cooling (635) the portion of the metal article from the nitriding temperature to the reduced temperature comprises cooling at a cooling rate, wherein the cooling rate is equivalent to or greater than an air-cooling rate.

B3. The method (600) of any of paragraphs B-B2.2, wherein the case-nitriding (610) comprises:

positioning (615) the metal article in a nitriding chamber;

providing (620) a nitrogen-containing gas to the nitriding chamber;

heating (625) a/the portion of the metal article to a nitriding temperature that is in the range of 60% to 99% of the melting point of the metal (108) or the metal alloy (110), wherein the portion of the metal article extends from a surface (104) of the metal article to a selected depth from the surface (104).

B3.1 The method (600) of paragraph B3, the nitriding temperature is selected to be within a solution treatment temperature range of the metal (108) or metal alloy (110).

B3.2. The method (600) of any of paragraphs B3-B3.1, wherein the nitriding temperature is at least one of at least 1,000 degrees Celsius (° C.), at least 1,100° C., at least 1,200° C., at least 1,300° C., at least 1,325° C., at least 1,350° C., at least 1,375° C., at least 1,400° C., at least 1,425° C., at least 1,450° C., at least 1,475° C., at least 1,500° C., at least 1,525° C., at most 1,325° C., at most 1,350° C., at most 1,375° C., at most 1,400° C., at most 1,425° C., at most 1,450° C., at most 1,475° C., at most 1,500° C., at most 1,525° C., and/or at most 1,600° C.

B3.3. The method (600) of any of paragraphs B3-B3.2, wherein the case-nitriding (610) further comprises maintaining (630) the portion of the metal article at the nitriding temperature for a nitriding time.

B3.3.1. The method (600) of paragraph B3.3, wherein the nitriding time is at least one of at least 3 minutes, at least 5 minutes, at least 8 minutes, at least 10 minutes, at least 15 minutes, at least 20 minutes, at most 8 minutes, at most 10 minutes, at most 15 minutes, at most 20 minutes, at most 30 minutes, and at most 40 minutes.

B3.4. The method (600) of any of paragraphs B3-B3.3.1, wherein the heating (625) the portion of the metal article comprises inductively heating the portion of the metal article.

B4. The method (600) of any of paragraphs B-B3.4, wherein the case-nitriding (610) comprises forming a nitrided case layer (106) in the metal article that extends from a/the surface (104) of the metal article towards a core (112) of the metal article.

B4.1. The method (600) of paragraph B4, wherein the case-nitriding (610) comprises forming one or more nitrogen-containing phases (120) within nitrided case layer (106).

B5. The method (600) of any of paragraphs B-B4.1, further comprising finishing (640) one of the hardened case-nitrided metal article (100) and the case-nitrided metal article (90).

B5.1. The method (600) of paragraph B5, wherein the finishing (640) comprises removing a film of porous metal nitride from a surface (104) of the one of the hardened case-nitrided metal article (100) and the case-nitrided metal article (90), and wherein the removing comprises one or more of polishing, sanding, milling, blasting, and/or etching the surface (104) of the one of the hardened case-nitrided metal article (100) and the case-nitrided metal article (90) to remove the film of porous metal nitride therefrom.

B6. The method (600) of any of paragraphs B-B5.1, further comprising forming (605) the metal article.

B6.1. The method (600) of paragraph B6, wherein the forming (605) comprises one or more of casting the metal article, milling the metal article, shaping the metal article, additively manufacturing the metal article, and cutting the metal article.

B7. The method (600) of any of paragraphs B6-B6.1, wherein the metal article is a wear part (200) or a gear (202), and wherein the method (600) comprises producing a hardened case-nitrided wear part (200) from the wear part (200) or producing a hardened case-nitrided gear (202) from the gear (202).

B7.1 The method (600) of paragraph B7, when depending from paragraph B6, wherein the forming (605) comprises forming the wear part (200) or the gear (202).

B8. The method (600) of any of paragraphs B-B7.1, wherein the metal article is formed of a titanium alloy.

B8.1. The method (600) of paragraph B8, wherein the metal article is formed of Ti-5553.

C. A hardened case-nitrided metal article (100), comprising:

a body (102) formed of a metal (108) or a metal alloy (110);

a surface (104) surrounding the body (102);

a nitrided case layer (106) formed in the body (102) and extending inwardly from the surface (104) towards a core (112) of the body (102); and wherein the hardened case-nitrided metal article (100) is nitrided by a nitriding process and subsequently hardened by a heat-aging process, and wherein the nitrided case layer (106) of the hardened case-nitrided metal article (100) has a hardness that is greater than that of the nitrided case layer (106) of an otherwise equivalent case-nitrided metal article (90) that has not been hardened by the heat-aging process.

C1. The hardened case-nitrided metal article (100) of paragraph C, wherein the nitrided case layer (106) has an effective case depth (114) that is greater than an effective case depth (114) of the nitrided case layer (106) of the otherwise equivalent case-nitrided metal article (90).

C1.1. The hardened case-nitrided metal article (100) of paragraph C1, wherein the effective case depth (114) of the hardened case-nitrided metal article (100) is at least one of at least 0.25 millimeters (mm), at least 0.45 mm, at least 0.5 mm, at least 0.55 mm, at least 0.6 mm, at least 0.65 mm, at least 0.7 mm, at most 0.8 mm, at most 0.9 mm, and at most 1 mm.

C1.2. The hardened case-nitrided metal article (100) of any of paragraphs C1-C1.1., wherein the effective case depth (114) of the hardened case-nitrided metal article (100) is greater than the effective case depth (114) of the otherwise equivalent case-nitrided metal article (90) by at least one of at least 0.25 mm, at least 0.45 mm, at least 0.5 mm, at least 0.55 mm, at least 0.6 mm, at least 0.65 mm, at least 0.7 mm, at most 0.8 mm, at most 0.9 mm, and at most 1 mm.

C2. The hardened case-nitrided metal article (100) of any of paragraphs C1-C1.2, wherein the nitrided case layer (106) defines has a total case depth (116), and wherein the effective case depth (114) is defined within the total case depth (116).

C3. The hardened case-nitrided metal article (100) of any of paragraphs C-C2, wherein the nitrided case layer (106) comprises a second hardness at a given depth within the nitrided case layer (106) and the otherwise equivalent case-nitrided metal article (90) comprises a first hardness at the given depth within the nitrided case layer (106) and wherein the second hardness is greater than the first hardness.

C3.1. The hardened case-nitrided metal article (100) of paragraph C3, wherein the second hardness is a threshold fraction of the first hardness, and wherein the threshold fraction of the second hardness to the first hardness is at least one of at least 1.1, at least 1.2, at least 1.3, at least 1.4, at least 1.5, at least 1.6, at least 1.7, at least 2, at most 1.2, at most 1.3, at most 1.4, at most 1.5, at most 1.6, at most 1.7, at most 1.8, at most 1.9, at most 2, and at most 3.

C4. The hardened case-nitrided metal article (100) of any of paragraphs C-C3.1, wherein the nitrided case layer (106) comprises one or more nitrogen-containing phases (120).

C4.1. The hardened case-nitrided metal article (100) of paragraph C4, wherein the one or more nitrogen-containing phases (120) include one or more of one or more metal nitrides, one or more dissolved nitrogen-containing phases, and/or one or more interstitial nitrogen-containing phases.

C5. The hardened case-nitrided metal article (100) of any of paragraphs C-C4.1, wherein the hardened case-nitrided metal article (100) is formed of at least one of a metal, an elemental metal, a metal alloy, a precipitation-hardening metal, a precipitation-hardening metal alloy, an iron alloy, a steel, stainless steel, a titanium alloy, a Ti-A1-V—Mo—Cr alloy, Ti-5553, a Ti-A1-V alloy, and/or Ti-64.

C5.1 The hardened case-nitrided metal article (100) of paragraph C5, wherein the hardened case-nitrided metal article (100) is formed of a titanium alloy.

C5.1.1. The hardened case-nitrided metal article (100) of paragraph C5.1, wherein the hardened case-nitrided metal article (100) is formed of Ti-5553.

C6. The hardened case-nitrided metal article (100) of any of paragraphs C-C5.1.1, wherein the hardened case-nitrided metal article (100) is, or is included in, a wear part (200).

C6.1. The hardened case-nitrided metal article (100) of paragraphs C6, wherein the surface (104) of the hardened case-nitrided metal article (100) is included in, or defines, a wear surface (206) of the wear part (200).

C6.1.1. The hardened case-nitrided metal article (100) of paragraph C6.1, wherein the wear part (200) is a gear (202).

C6.1.1.1. The hardened case-nitrided metal article (100) of paragraph C6.1.1, wherein the gear (202) defines a plurality of wear surfaces (206), and wherein a/the effective case depth (114) of the nitrided case layer (106) is at least substantially uniform across the plurality of wear surfaces (206).

C7. The hardened case-nitrided metal article (100) of any of paragraphs C-C6.1.1.1, wherein the hardened case-nitrided metal article (100) is formed by performing the method (600) of any of paragraphs B-B8.1.

C8. The hardened case-nitrided metal article (100) of any of paragraphs C-C7, wherein the hardened case-nitrided metal article (100) is hardened by performing the method (500) of any of paragraphs A-A11.1.

D. A mechanical system (300) comprising:

at least two wear parts (200) mechanically engaged with one another, wherein each wear part (200) of the at least two wear parts (200) is the wear part (200) of any of paragraphs C6-C6.1.1.1.

D1. The mechanical system (300) of paragraph D, wherein the at least two wear parts (200) are at least two gears (202) that are meshed with one another.

D2 The mechanical system (300) of any of paragraphs D-D1, wherein each wear part (200) of the at least two wear parts (200) is formed of Ti-5553.

E. A hardened case-nitrided titanium alloy article (100), comprising:

a body (102) formed of a titanium alloy;

a surface (104) surrounding the body (102);

a nitrided case layer (106) formed in the body (102) and extending inwardly from the surface (104) towards a core (112) of the body (102); and wherein the nitrided case layer (106) has an effective case depth (114) of at least one of at least 0.25 mm, at least 0.45 mm, at least 0.5 mm, at least 0.55 mm, at least 0.6 mm, at least 0.65 mm, at least 0.7 mm, at most 0.8 mm, at most 0.9 mm, and at most 1 mm.

E1. The hardened case-nitrided titanium alloy article (100) of paragraph E, wherein the nitrided case layer (106) has an effective case depth (114) of at least 0.25 mm and at most 0.7 mm.

E2. The hardened case-nitrided titanium alloy article (100) of any of paragraphs E-E1, wherein the titanium alloy is Ti-5553.

E3. The hardened case-nitrided titanium alloy article (100) of any of paragraphs E-E2, wherein the hardened case-nitrided titanium alloy article (100) is, or is included in, a wear part (200).

E3.1. The hardened case-nitrided titanium alloy article (100) of paragraph E3, wherein the surface (104) of the hardened case-nitrided titanium alloy article (100) is included in, or defines, a wear surface (206) of the wear part (200).

E.3.2. The hardened case-nitrided titanium alloy article (100) of any of paragraphs E3-E3.1, wherein the wear part (200) is a gear (202).

E3.2.1. The hardened case-nitrided titanium alloy article (100) of paragraph E3.2, wherein the gear (202) defines a plurality of wear surfaces (206), and wherein the effective case depth (114) is at least substantially uniform across the plurality of wear surfaces (206).

E4. The hardened case-nitrided titanium alloy article (100) of any of paragraphs E-E4 formed according to the method (600) of any of paragraphs B-B8.1.

E5. The hardened case-nitrided titanium alloy article (100) of paragraphs E-E3.2.1 hardened according to the method (500) of any of paragraphs A-A11.1.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, the terms "selective" and "selectively," when modifying an action, movement, configuration, or other activity of one or more components or characteristics of an apparatus, mean that the specific action, movement, configuration, or other activity is a direct or indirect result of one or more dynamic processes, as described herein. The terms "selective" and "selectively" thus may characterize an activity that is a direct or indirect result of user manipulation of an aspect of, or one or more components of, the apparatus, or may characterize a process that occurs automatically, such as via the mechanisms disclosed herein.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the term "and/or" placed between a first entity and a second entity means one of (1) the first entity, (2) the second entity, and (3) the first entity and the second entity. Multiple entries listed with "and/or" should be construed in the same manner, i.e., "one or more" of the entities so conjoined. Other entities optionally may be present other than the entities specifically identified by the "and/or" clause, whether related or unrelated to those entities specifically identified. Thus, as a non-limiting example, a reference to "A and/or B," when used in conjunction with open-ended language such as "comprising," may refer, in one example, to A only (optionally including entities other than B); in another example, to B only (optionally including entities other than A); in yet another example, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, an object that is at least substantially formed from a material includes an object for which at least 75% of the object is formed from the material and also includes an object that is completely formed from the material. As another example, a first direction that is at least substantially parallel to a second direction includes a first direction that forms an angle with respect to the second direction that is at most 22.5 degrees and also includes a first direction that is exactly parallel to the second direction. As another example, a first length that is substantially equal to a second length includes a first length that is at least 75% of the second length, a first length that is equal to the second length, and a first length that exceeds the second length such that the second length is at least 75% of the first length.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order, concurrently, and/or repeatedly. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of hardening a case-nitrided metal article, the method comprising:

heat-aging the case-nitrided metal article, wherein the heat-aging comprises:

heating the case-nitrided metal article to an aging temperature, wherein the heating is performed with the case-nitrided metal article positioned within a heat-aging chamber;

applying a heat-aging atmosphere to the case-nitrided metal article within the heat-aging chamber, maintaining the case-nitrided metal article at the aging temperature for an aging time; and cooling the case-nitrided metal article from the aging temperature, wherein the method results in a hardened case-nitrided metal article, comprising:

a body;

a surface surrounding the body; and a nitrided case layer formed in the body and extending inwardly from the surface towards a core of the body; and wherein the nitrided case layer has an effective case depth of at least 0.25 millimeters (mm).

2. The method of claim 1, wherein the heating comprises heating the case-nitrided metal article from room temperature.

3. The method of claim 1, wherein the case-nitrided metal article is formed of an iron alloy.

4. The method of claim 1, wherein the case-nitrided metal article is formed of a steel.

5. The method of claim 1, wherein the case-nitrided metal article is formed of a stainless steel.

6. The method of claim 1, wherein the case-nitrided metal article is formed of a titanium alloy.

7. The method of claim 1, wherein the heat-aging comprises increasing the effective case depth of the nitrided case layer.

8. The method of claim 1, wherein the heat-aging comprises increasing the effective case depth of the nitrided case layer by at least 0.25 mm.

9. The method of claim 1, wherein the case-nitrided metal article is a case-nitrided wear part, and wherein the heat-aging comprises increasing a wear resistance of the case-nitrided wear part.

10. The method of claim 1, wherein the case-nitrided metal article is formed from a metal or a metal alloy that is selected to be compatible with solution treatment and aging.

11. A method of hardening a case-nitrided metal article, the method comprising:

heating the case-nitrided metal article to an aging temperature;

maintaining the case-nitrided metal article at the aging temperature for an aging time;

cooling the case-nitrided metal article from the aging temperature; and applying a heat-aging atmosphere to the case-nitrided metal article within a heat-aging chamber, wherein the heating is performed with the case-nitrided metal article positioned within the heat-aging chamber.

12. The method of claim 11, wherein the heating comprises heating the case-nitrided metal article from room temperature.

13. The method of claim 11, wherein the aging temperature is at least 550 degrees Celsius (° C.).

14. The method of claim 11, wherein the aging time is at least 7 hours.

15. The method of claim 11, wherein the case-nitrided metal article includes a nitrided case layer that extends inwardly from a surface of the case-nitrided metal article towards a core of the case-nitrided metal article, and wherein the method comprises increasing an effective case depth of the nitrided case layer.

16. The method of claim 15, wherein the increasing comprises increasing the effective case depth by at least 0.25 millimeters (mm).

17. The method of claim 11, wherein the case-nitrided metal article is a case-nitrided wear part, and wherein the method comprises increasing a wear resistance of the case-nitrided wear part.

18. The method of claim 11, wherein the applying the heat-aging atmosphere comprises evacuating the heat-aging chamber and subsequently supplying the heat-aging atmosphere to the heat-aging chamber.

19. The method of claim 18, wherein the applying comprises removing oxygen gas from the heat-aging chamber and supplying an inert gas to the heat-aging chamber.

20. The method of claim 18, wherein the applying further comprises applying a negative pressure to the heat-aging chamber, and wherein the maintaining comprises maintaining the negative pressure in the heat-aging chamber during the heating.

21. The method of claim 11, wherein the case-nitrided metal article is formed from a metal or a metal alloy that is selected to be compatible with solution treatment and aging.

* * * * *